US009656399B2

(12) United States Patent
Brainard

(10) Patent No.: US 9,656,399 B2
(45) Date of Patent: May 23, 2017

(54) PULL-TYPE CUTTERS

(71) Applicant: Paul Brainard, La Verne, CA (US)

(72) Inventor: Paul Brainard, La Verne, CA (US)

( * ) Notice: Subject to any disclaimer, the term of this patent is extended or adjusted under 35 U.S.C. 154(b) by 0 days.

(21) Appl. No.: 15/220,341

(22) Filed: Jul. 26, 2016

(65) Prior Publication Data

US 2017/0036339 A1 Feb. 9, 2017

Related U.S. Application Data

(63) Continuation-in-part of application No. 14/881,086, filed on Oct. 12, 2015, now Pat. No. 9,446,527.

(60) Provisional application No. 62/202,154, filed on Aug. 6, 2015.

(51) Int. Cl.

| | |
|---|---|
| ***B26B 13/26*** | (2006.01) |
| ***B25G 1/06*** | (2006.01) |
| ***B25G 1/10*** | (2006.01) |
| ***B26B 27/00*** | (2006.01) |

(52) U.S. Cl.

CPC ..... *B26B 13/26* (2013.01); *B25G 1/06* (2013.01); *B25G 1/102* (2013.01); *B26B 27/00* (2013.01)

(58) Field of Classification Search

CPC ..... B26B 27/00; B26B 13/26; B25G 1/06; B25G 1/102

USPC ..... 30/238, 235, 244–251, 253, 257–259

See application file for complete search history.

(56) References Cited

U.S. PATENT DOCUMENTS

| | | | |
|---|---|---|---|
| 97,973 | A | 12/1869 | Shehan |
| 103,873 | A | 6/1870 | Grover |
| 124,455 | A | 3/1872 | Snell |
| 126,888 | A | 5/1872 | Keethler |
| 146,942 | A | 1/1874 | Nunan |
| 187,064 | A | 2/1877 | Stroop |
| 313,259 | A | 3/1885 | Upton |
| 334,582 | A | 1/1886 | Haas |
| 354,363 | A | 12/1886 | Titus |
| 361,911 | A | 4/1887 | Weston |
| 397,698 | A | 2/1889 | Cooper |
| 453,669 | A | 6/1891 | Scheewe |
| 460,705 | A | 10/1891 | Hansen |

(Continued)

FOREIGN PATENT DOCUMENTS

| | | |
|---|---|---|
| GB | 2220606 | 1/1990 |

OTHER PUBLICATIONS

International Search Report and Written Opinion for PCT/US16/44344 dated Oct. 7, 2016; 9 pages.

*Primary Examiner* — Jason Daniel Prone
(74) *Attorney, Agent, or Firm* — Loza & Loza, LLP; Razmig H. Messerian

(57) ABSTRACT

One feature pertains to cutters that include a first lever, a second lever having a bottom edge, and a cutting lever having a top edge. A first member rotatably couples the first lever to the second lever, a second member couples the cutting lever to the first lever and/or the second lever, where the second member provides a pivot for the cutting lever to rotate relative to the second lever. A means for rotating the cutting lever relative to the second lever to move the top edge toward or away from the bottom edge when the first lever's first end is moved relative to the second lever's first end is provided, where the first lever, the second lever, and the cutting lever are arranged in a side-by-side configuration such that each has a longitudinal axis that is parallel to each other when the cutters are in a closed position.

18 Claims, 39 Drawing Sheets

(56) References Cited

U.S. PATENT DOCUMENTS

| | | | |
|---|---|---|---|
| 476,114 | A | 5/1892 | Andrews |
| 502,809 | A | 8/1893 | Caspian |
| 512,451 | A | 1/1894 | Shultz |
| 677,419 | A | 7/1901 | Lott |
| 692,673 | A | 2/1902 | Joseph |
| 709,478 | A | 9/1902 | Fortney |
| 777,366 | A | 12/1904 | Bergmark |
| 838,298 | A | 12/1906 | Briggs |
| 907,065 | A | 12/1908 | Litzelman |
| 975,059 | A | 11/1910 | Meissner |
| 985,048 | A | 2/1911 | Meissner |
| 996,674 | A | 7/1911 | Randle |
| 1,009,009 | A | 11/1911 | Bachand et al. |
| 1,447,483 | A | 3/1923 | Pazos |
| 1,507,529 | A | 6/1923 | Sundman |
| 1,666,832 | A | 4/1928 | Perl et al. |
| 1,700,174 | A | 1/1929 | McMillan |
| 2,326,178 | A | 8/1943 | Seeberger |
| 2,391,598 | A | 12/1945 | Serdich |
| 2,568,234 | A | 9/1951 | Haufrect |
| 2,665,755 | A | 1/1954 | McCoy |
| 2,808,647 | A | 10/1957 | Ikeuchi |
| 2,897,591 | A | 8/1959 | Nastasi, et al. |
| 2,915,821 | A | 12/1959 | Partin |
| 3,090,121 | A | 5/1963 | Chonka |
| 3,279,063 | A | 10/1966 | Chalup |
| 3,333,607 | A | 8/1967 | Haraden |
| 3,338,281 | A | 8/1967 | Davy |
| 3,438,130 | A | 4/1969 | Ballard |
| 3,721,245 | A | 3/1973 | Campbell |
| 3,738,002 | A | 6/1973 | Coughtrie |
| 4,058,894 | A | 11/1977 | Leturgez |
| 4,285,344 | A | 8/1981 | Marshall |
| 4,507,864 | A | 4/1985 | Leibowitz |
| 4,958,435 | A | 9/1990 | Grubbs et al. |
| 4,965,992 | A | 10/1990 | Jacobs |
| 5,074,046 | A | 12/1991 | Kolesky |
| 5,092,049 | A | 3/1992 | Grubbs et al. |
| 5,193,277 | A | 3/1993 | Zmijewski |
| 5,860,215 | A | 1/1999 | Roskam et al. |
| 5,943,779 | A | 8/1999 | Antonio, Jr. |
| 6,079,107 | A | 6/2000 | Horvath |
| 6,199,284 | B1 | 3/2001 | Nilsson et al. |
| 6,754,961 | B2 | 6/2004 | Brockhage |
| 6,813,836 | B2 | 11/2004 | Graca |
| 7,690,118 | B2 | 4/2010 | Yamakado |
| 9,446,527 | B1 * | 9/2016 | Brainard ..... B25G 1/06 30/251 |
| 2003/0167640 | A1 | 9/2003 | Heck et al. |
| 2005/0283981 | A1 | 12/2005 | Yizhar |
| 2010/0162575 | A1 | 7/2010 | Lin |
| 2010/0236080 | A1 | 9/2010 | Huang |
| 2015/0328784 | A1 * | 11/2015 | Awauchi ..... B26B 13/20 30/257 |
| 2016/0088801 | A1 * | 3/2016 | Sampson ..... B26B 13/26 30/251 |

* cited by examiner

PULL-TYPE CUTTERS

CLAIM OF PRIORITY

The present application for patent claims priority to provisional application No. 62/202,154 entitled "Scissors" filed Aug. 6, 2015. The present application is a continuation-in-part of application Ser. No. 14/881,086 entitled "PULL-TYPE CUTTERS" filed Oct. 12, 2015, now U.S. Pat. No. 9,446,527 B1, which also claims priority to provisional application No. 62/202,154 entitled "Scissors" filed Aug. 6, 2015, the entire disclosures of which are hereby expressly incorporated by reference.

BACKGROUND

Field

Various features relate to cutters (e.g., scissors, shears, etc.), and more specifically, to hand-held pull-type cutters that allow a user to cut material while moving or pulling the cutters towards the user.

Background

Conventional hand-held cutters have cutting blades that extend out from a pivot member in a direction that is substantially opposite the cutters' handle arms used to operate the conventional cutters. A user operating such conventional cutters manually squeezes together and pulls apart the handle arms, which in turn moves the cutting blades toward and away from one another about the pivot member, to cut material positioned between the cutting blades. Notably, the user must steadily push the cutters out away from themselves while operating the cutters to cut additional material.

One disadvantage of such a design is that the user's hands or the cutters' handle arms may interfere with the material as it is cut. This is particularly problematic when the material being cut is rigid, such as a sheet of metal, hard plastic, wood, or cardboard, since the rigid material cannot easily bend out of the way of the cutters' moving handle arms. Thus, attempting to cut a rigid material with such conventional cutters, especially when attempting to make angled cuts, may prove very difficult or unsafe due to the sharp edges of the material that have been cut which tend to brush against the user's hand.

Another disadvantage of the conventional hand-held cutters' design is that of safety. Since the cutting blades may have sharpened edges or sharpened points facing away from the user holding the cutters at their handle arms, walking or running about a space while holding such cutters may unintentionally hurt someone.

There is a need for improved designs for hand-held cutters that allow a user to make precision cuts efficiently and effectively. Such cutters should allow the user to cut material, even rigid material, without the cut material interfering with the operation of the cutters itself. Moreover, the cutters should feature improved safety over conventional designs.

SUMMARY OF INVENTION

One feature provides cutters comprising a first lever having a first end, a second lever having a first end and a bottom edge, a cutting lever having a top edge, a first member rotatably coupling the first lever to the second lever, a second member coupling the cutting lever to at least one of the first lever or the second lever, the second member providing a pivot for the cutting lever to rotate relative to the second lever, and means for rotating the cutting lever relative to the second lever to move the top edge toward or away from the bottom edge when the first lever's first end is moved relative to the second lever's first end, wherein the first lever, the second lever, and the cutting lever are arranged in a side-by-side configuration such that when the cutters are in a closed position the first lever and the cutting lever sandwich the second lever. According to one aspect of the present disclosure, the first member is positioned closer to the first lever's first end and the second lever's first end than the second member. According to another aspect, the second member is positioned closer to the first lever's first end and the second lever's first end than the first member.

According to one aspect, the top edge of the cutting lever extends in a direction away from the second member that is substantially a same direction as the second lever's first end when the cutters are in a closed position. According to another aspect, the means for rotating the cutting lever relative to the second lever includes a third member that passes through an opening in the second lever to couple the first lever to the cutting lever. According to yet another aspect, the means for rotating the cutting lever relative to the second lever includes a third member that bypasses the second lever to couple the first lever to the cutting lever.

According to one aspect, the third member includes an elongated shaft. According to another aspect, the means for rotating the cutting lever relative to the second lever includes a gear coupled to the first member and the cutting lever, the gear interfacing with a toothed portion of the cutting lever. According to yet another aspect, the first lever is fixedly coupled to a first end of the first member and the gear is fixedly coupled to a second end of the first member such that rotating the first lever causes the first member and the gear to rotate in a same direction as the first lever and rotate the cutting lever in an opposite direction as the first lever.

According to one aspect, the means for rotating the cutting lever relative to the second lever includes a third lever and a third member, the third member rotatably coupling the first lever to the third lever. According to another aspect, the third lever is fixedly coupled to a first end of the second member and a second end of the second member is fixedly coupled to the cutting lever, the third member adapted to rotate the third lever and the second member when the first lever's first end is moved relative to the second lever's first end causing the cutting lever to rotate in a same direction as the third member. According to yet another aspect, the means for rotating the cutting lever relative to the second lever includes a gear that engages with a toothed end of the first lever, the toothed end opposite the first lever's first end.

According to one aspect, the gear is fixedly coupled to a first end of the second member and a second end of the second member is fixedly coupled to the cutting lever, the toothed end of the first lever adapted to rotate the gear and the second member when the first lever's first end is moved relative to the second lever's first end causing the cutting lever to rotate in a same direction as the gear. According to another aspect, the means for rotating the cutting lever relative to the second lever includes a third member that passes through an opening in the cutting lever and an opening in the second lever to couple the cutting lever to the second lever, the second member bypassing the second lever to couple the cutting lever to the first lever.

Another feature provides cutters comprising a first lever having a first end that includes a first handle, a second lever having a first end that includes a second handle, the second lever including a bottom edge, a cutting lever having a top edge, at least one of the bottom edge or the top edge being sharp, a first member coupling the first lever to the second lever and providing a pivot for the first lever to rotate relative to the second lever, a second member coupling the cutting lever to at least one of the first lever or the second lever, the second member providing a pivot for the cutting lever to rotate relative to the second lever, and means for rotating the cutting lever relative to the second lever to move the top edge toward or away from the bottom edge when the first handle is moved relative to the second handle, wherein the first lever, the second lever, and the cutting lever are arranged in a side-by-side configuration such that each has a longitudinal axis that is substantially parallel to each other when the cutters are in a closed position and the second lever is positioned between the first lever and the cutting lever, and the first member and the second member have longitudinal axes that intersect with at least one of the first lever, the second lever, or the cutting lever at different positions. According to one aspect, the first member is positioned closer to the first and second handles than the second member. According to another aspect, the second member is positioned closer to the first and second handles than the first member.

According to one aspect, the top edge of the cutting lever extends in a direction away from the second member that is substantially a same direction as the second handle when the cutters are in a closed position. According to another aspect, the means for rotating the cutting lever relative to the second lever includes a third member that bypasses the second lever to couple the first lever to the cutting lever.

Another feature provides cutters comprising a first lever having a first end that includes a first handle, a second lever having a first end that includes a second handle, the second lever including a bottom edge, a cutting lever having a top edge, at least one of the bottom edge or the top edge being sharp, a first member rotatably coupling the first lever to the second lever, a second member coupling the cutting lever to at least one of the first lever or the second lever, the second member providing a pivot for the cutting lever to rotate relative to the second lever, and a third member coupled to the cutting lever and at least one of the first lever or the second lever, the third member adapted to rotate the cutting lever about the second member to move the top edge toward or away from the bottom edge when the first handle is moved relative to the second handle, wherein the first lever, the second lever, and the cutting lever are arranged in a side-by-side configuration such that each has a longitudinal axis that is substantially parallel to each other when the cutters are in a closed position and the first lever and the cutting lever sandwich the second lever, and the first member and the second member have longitudinal axes that orthogonally intersect with at least one of the first lever, the second lever, or the cutting lever at different positions.

Another feature provides an apparatus comprising a first lever having a first end, a second lever having a first end, the second lever including a bottom edge, a cutting lever having a top edge, a first member rotatably coupling the cutting lever to the second lever, and a second member coupling the first lever to the cutting lever by passing through the second lever, the first lever adapted to move the second member when the first end of the first lever is moved relative to the first end of the second lever, moving the second member causes the cutting lever to rotate about the first member to move the top edge toward or away from the bottom edge, and wherein the top edge extends from the first member in a substantially same direction as the first end of the first lever and the first end of the second lever. According to one aspect, an opening in the second lever allows the second member coupling the first lever to the cutting lever to pass through the second lever, and the first lever is adapted to move the second member within the opening. According to another aspect, the first member is positioned closer to the first ends of the first and second levers than the second member.

According to one aspect, the second member is positioned closer to the first ends of the first and second levers than the first member. According to another aspect, the first lever is adapted to move within a first vertical plane that is different than a second vertical plane that the second lever is adapted to move within, the first lever and the second lever positioned adjacent to each other. According to yet another aspect, the second lever is positioned in between the first lever and the cutting lever.

According to one aspect, the apparatus further comprises a third member rotatably coupling the first lever to the second lever, and at least one of the first lever and/or the second lever includes a plurality of holes to which the third member is adapted to pass through to adjust leverage of the apparatus. According to another aspect, the top edge and the bottom edge define a cutting region having an open end when the apparatus is placed in an open position, the open end adapted to receive sheet material to be cut. According to yet another aspect, the cutting lever is adapted to rotate about the first member to such a degree that the top edge and bottom edge meet placing the apparatus in a closed position.

DETAILED DESCRIPTION

In the following description, specific details are given to provide a thorough understanding of the various aspects of the disclosure. However, it will be understood by one of ordinary skill in the art that the aspects may be practiced without these specific details. The word "exemplary" is used herein to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "cutters" as used herein includes shears and scissors. As used herein, the terms "coupled" and "coupling" mean that two components are directly or indirectly connected to each other. Thus, the two components may be directly touching each other or there may be an intermediary component between the two components that connects the two components together.

Overview

Various aspects of hand-held cutters are described herein. The cutters are of a type that allows a user operator (herein "user") to cut material while pulling or otherwise moving the cutters towards the user. The material cut can vary widely but may include paper, cardboard, metal, wood, plastic, rubber, etc. Thus, sheets of paper, cardboard, wood, metal, rubber, or plastic may all be cut safely and efficiently.

First Aspect

Figure 1:
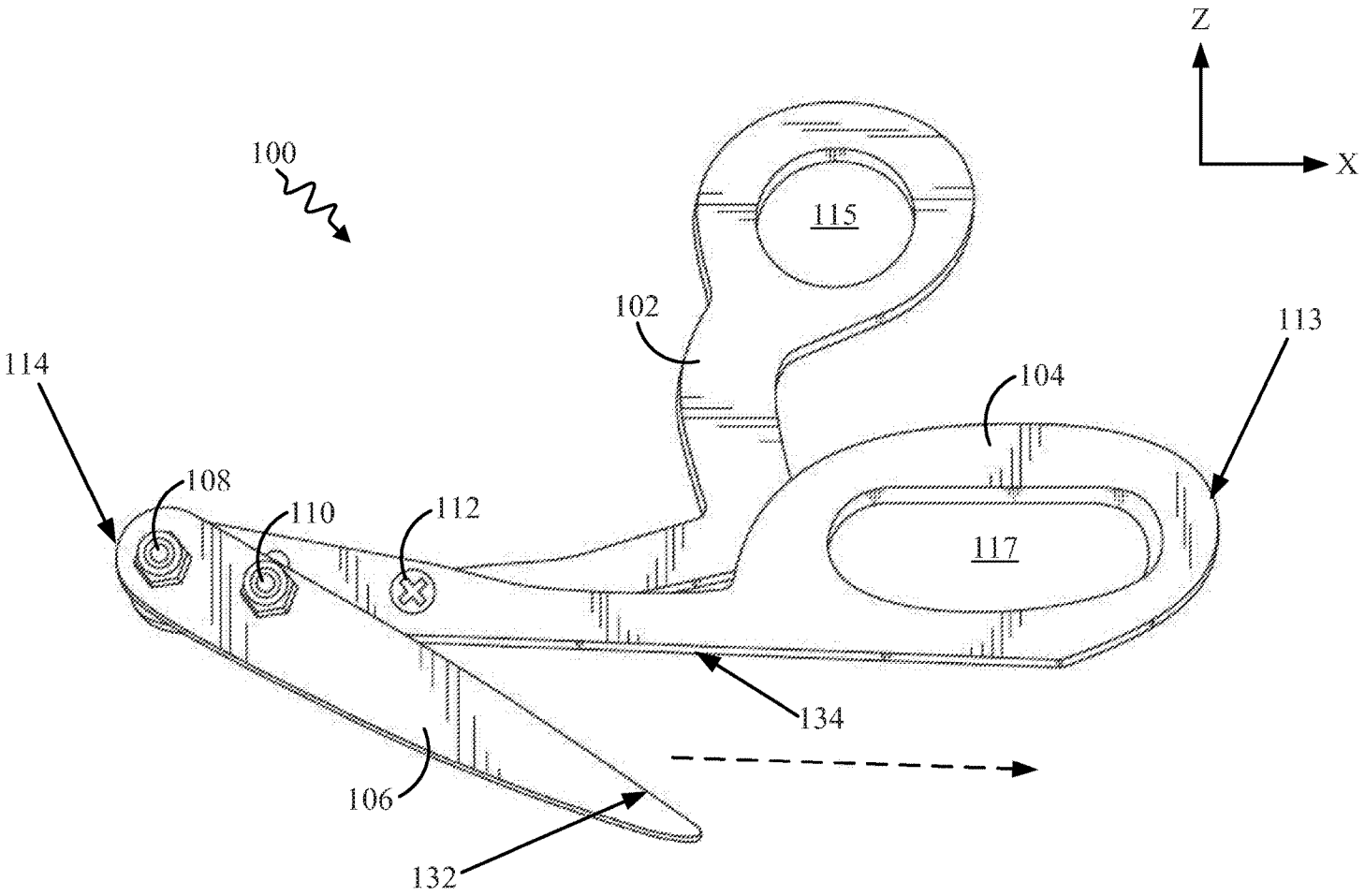
FIG. 1 illustrates a front-perspective view of a first aspect of cutters in an open position.
Figure 2:
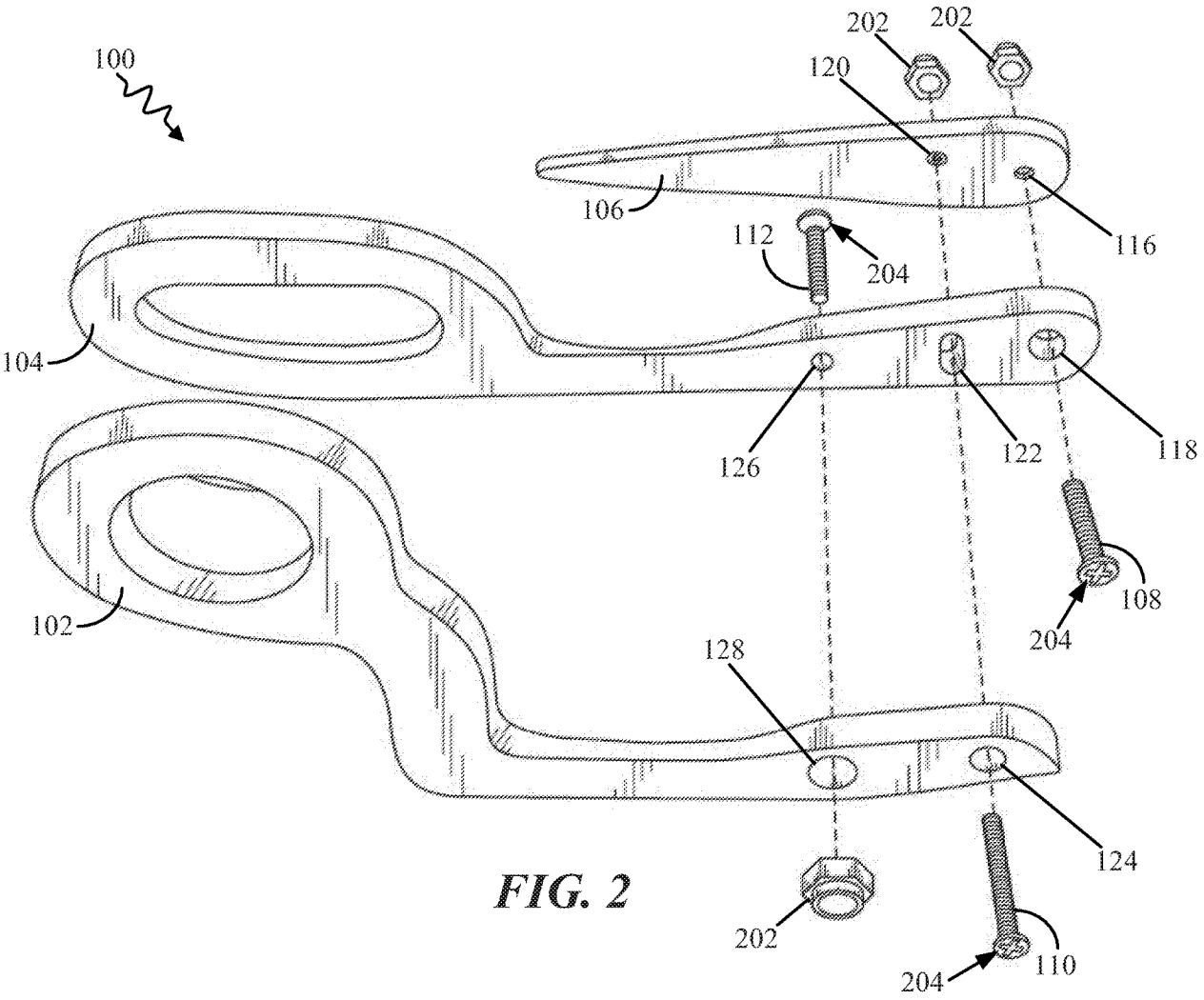
FIG. 2 illustrates a rear, exploded view of the first aspect of the cutters.
Figure 3:
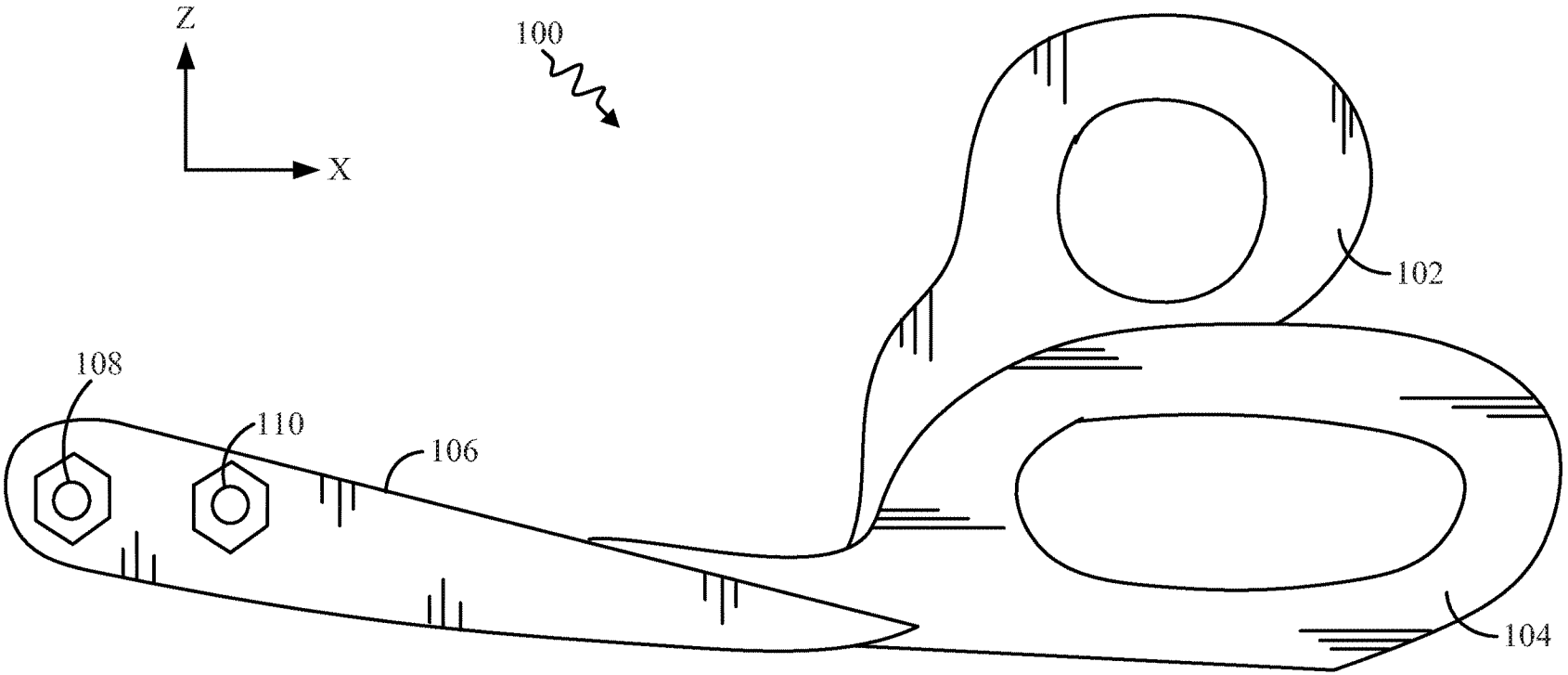
FIG. 3 illustrates a front-perspective view of the first aspect of the cutters in a closed position.
Figure 4:
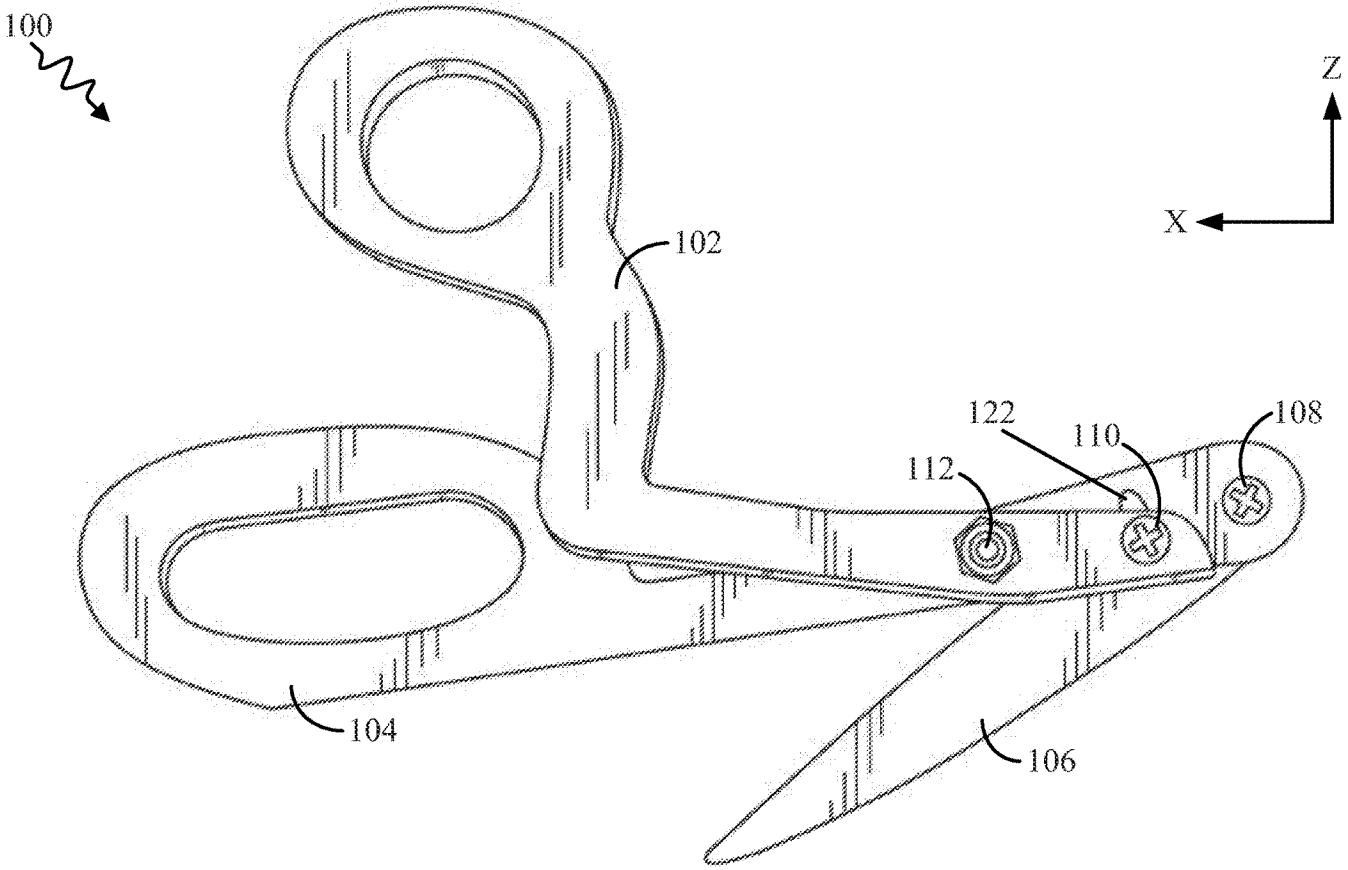
FIG. 4 illustrates a rear view of the first aspect of the cutters.
Figure 5:
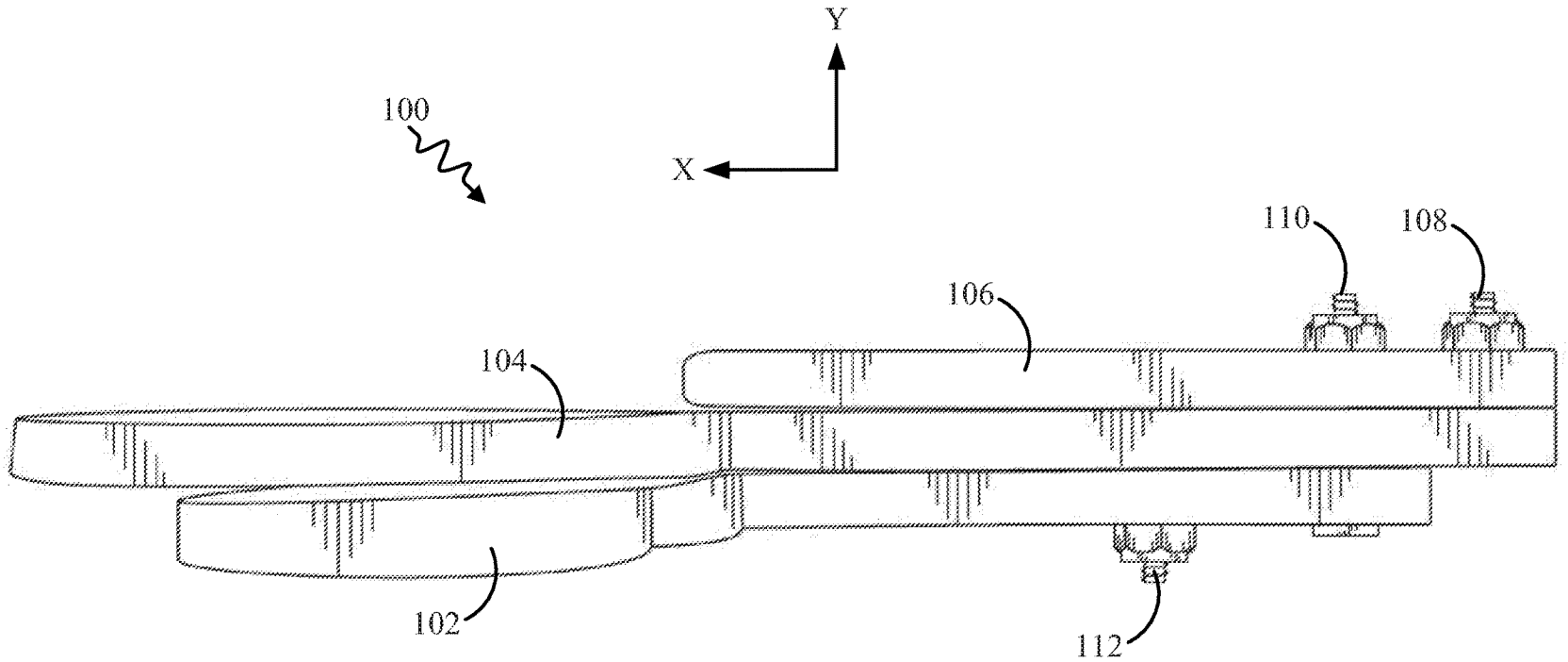
FIG. 5 illustrates a top view of the first aspect of the cutters.

FIGS. 1-5 illustrate cutters 100 according to a first aspect of the disclosure. Specifically, FIG. 1 illustrates a front-perspective view of the cutters 100 in an open position. FIG. 2 illustrates a rear, exploded view of the cutters 100. FIG. 3 illustrates a front-perspective view of the cutters 100 in a closed position. FIGS. 4 and 5 illustrate a rear view and a top view of the cutters 100, respectively. The cutters 100 may include a first lever 102 (e.g., "top lever"), a second lever 104 (e.g., "bottom lever"), a cutting lever 106, a first member 112 (e.g., "first pivot member" or "first pivot rod"), a second member 108 (e.g., "second pivot member" or "second pivot rod"), and a third member 110 (e.g., "connector"). The cutters 100 are operated by moving the top lever 102 and bottom lever 104 toward and away from each other. A user may do that by placing one or more fingers in the finger holes 115, 117 (e.g., "handles") of the top and bottom levers 102, 104 found near a first end 113 of the cutters 100 and spreading their fingers apart and back together. When the top lever 102 and bottom lever 104 are pulled apart/away from one another the cutters 100 are herein referred to as being in the "open position." By contrast, when the top lever 102 and bottom lever 104 are moved towards each other the cutters 100 are herein referred to as being in the "closed position." Referring to FIG. 5, the cutters 100 may be considered "horizontally-oriented cutters" in that the top and bottom levers 102, 104 are positioned adjacent to one another in the same horizontal plane (e.g., parallel to X-Y plane).

Referring to FIGS. 1 and 2, the second pivot rod 108, located near a second end 114 of the cutters 100, passes through a hole 116 in the cutting lever 106 and another hole 118 in the bottom lever 104 to couple the bottom lever 104 and the cutting lever 106 together. The cutting lever 106 may rotate with respect to the bottom lever 104 about the second pivot rod 108. The connector 110 passes through a hole 120 in the cutting lever 106, through a first slot 122 (e.g., "first opening") located in the bottom lever 104, and through a hole 124 in the top lever 102. The connector 110 couples the top lever 102 and the cutting lever 106 together, and in one aspect the connector 110 may be one example of a means for rotating the cutting lever 106 relative to the bottom lever 104 to move the cutting lever's top edge 132 toward or away from the second lever's bottom edge 134 when the first lever 102 or first handle 115 is moved relative to the second lever 104 or second handle 117. The connector 110 moves about freely within the slot 122. The first pivot rod 112 passes through a hole 126 in the bottom lever 104 and also through a second slot 128 ("e.g., second opening") located in the top lever 102. The second slot 128 allows the first pivot rod 112 to move slightly within the top lever 102. In one aspect, the first slot 122 and the second slot 128 may each have a curved shape like an arc having an inner side (e.g., intrados) that faces the second pivot rod 108. In other aspects, the slots 122, 128 may have other shapes including, but not limited to, other elongated shapes. In one aspect, the second slot 128 may be a circular hole.

In one aspect, the members 108, 110, 112 have one or more securing ends having diameters that are larger than the cross-sectional diameter of the members 108, 110, 112 in order to secure the members 108, 110, 112 within the one or more levers 102, 104, 106 and prevent them from falling out. According to one example, the securing ends may be fastening nuts 202. According to another example where the members are 108, 110, 112 are screws or bolts, one securing end of each member 108, 110, 112 may be a screw/bolt head 204 while the other end is a fastening nut 202. According to yet another example, the members 108, 110, 112 may be rivets.

Opening the cutters 100 by moving the top lever 102 up and away from the bottom lever 104 causes the top lever 102 to rotate (e.g., counterclockwise direction based on cutters' 100 orientation in FIG. 1) about the first pivot rod 112. It also causes the connector 110 to move down within the first slot 122, which in turn causes the cutting lever 106 to rotate (e.g., clockwise direction based on orientation in FIG. 1) about the second pivot rod 108. Rotating about the second pivot rod 108 in this fashion moves the cutting lever's top edge 132 away from the bottom lever's bottom edge 134. According to one aspect, at least one of the cutting lever's top edge 132 or the bottom lever's bottom edge 134 is sharpened in order to cut material positioned in between the cutting lever 106 and the bottom lever 104.

Closing the cutters 100 by moving the top lever 102 back towards the bottom lever 104 causes the top lever 102 to rotate (e.g., clockwise direction based on cutters' 100 orientation in FIG. 1) about the first pivot rod 112. It also causes the connector 110 to move up within the first slot 122, which in turn causes the cutting lever 106 to rotate (e.g., counterclockwise direction based on orientation in FIG. 1) about the second pivot rod 108. Rotating about the second pivot rod 108 in this fashion moves the cutting lever's top edge 132 toward the bottom lever's bottom edge 134. As the cutters 100 are closed, material located between the cutting lever 106 and the bottom lever 104 may be cut if at least one of the cutting lever's top edge 132 or the bottom lever's bottom edge 134 is sharp. The cutters 100 may be pulled in the direction of the dashed arrow (see FIG. 1) while opening and closing the cutters 100 as described above in order to cut additional material. The cutters 100 may also be maneuvered in curved paths while being operated (i.e., opening and closing the cutters 100) to cut curved shapes of material. The material cut can vary widely but may include paper, cardboard, metal, wood, plastic, rubber, etc.

Second Aspect

Figure 6:
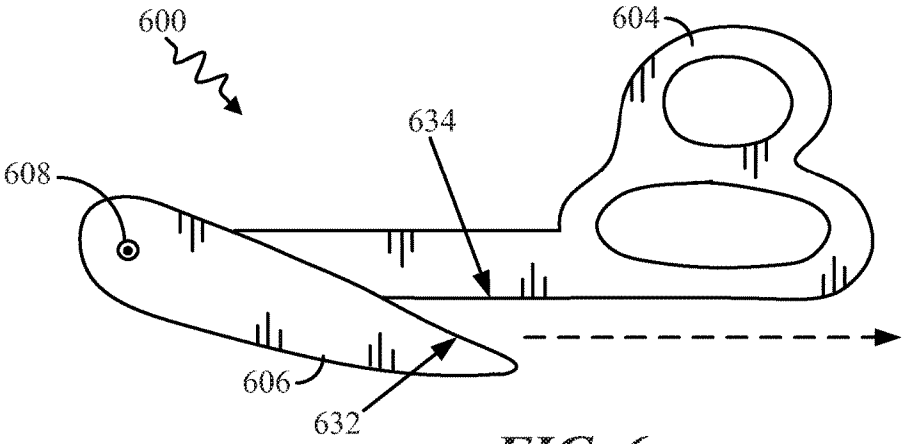
FIG. 6 illustrates a front view of a second aspect of cutters.
Figure 7:
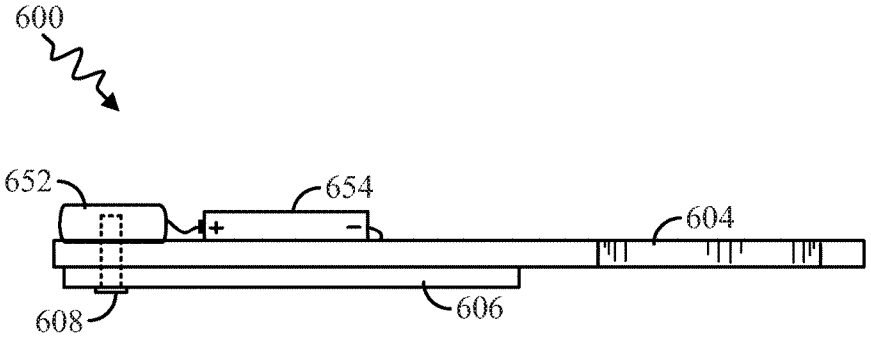
FIG. 7 illustrates a top view of the second aspect of the cutters.

FIGS. 6 and 7 illustrate cutters 600 according to a second aspect of the disclosure. Specifically FIG. 6 illustrates a front view of the cutters 600, and FIG. 7 illustrates a top view of the cutters 600. The cutters 600 shown in FIGS. 6 and 7 are similar to the cutters 100 shown in FIGS. 1-5 except that the cutters 600 of FIGS. 6 and 7 do not have a top lever 102, a connector 110, or a first pivot rod 112. Instead the cutters 600 have a bottom lever 604, a cutting lever 606, a first pivot member 608 (e.g., pivot rod), a motor 652, and a power source 654. The first pivot member 608 couples the cutting lever 606 to the motor 652. The motor 652 is coupled to the power source 654 (e.g., battery).

When the motor 652 is activated (e.g., via a switch (not shown)) it turns the first pivot member 608 back and forth (i.e., clockwise and counterclockwise), which in turn moves the cutting lever 606 back and forth (i.e., rotates the cutting lever clockwise and counterclockwise) relative to the bottom lever's bottom edge 634. If at least one of the cutting lever's top edge 632 or the bottom lever's bottom edge 634 is sharpened then material positioned in between the cutting lever 606 and the bottom lever 604 may be cut. The cutters 600 may be pulled in the direction of the dashed arrow (see FIG. 6) while being operated in order to cut more material. The cutters 600 may also be maneuvered in curved paths while operating the cutters 600 (i.e., motor 652 activated) to cut curved shapes of material.

Third Aspect

Figure 8:
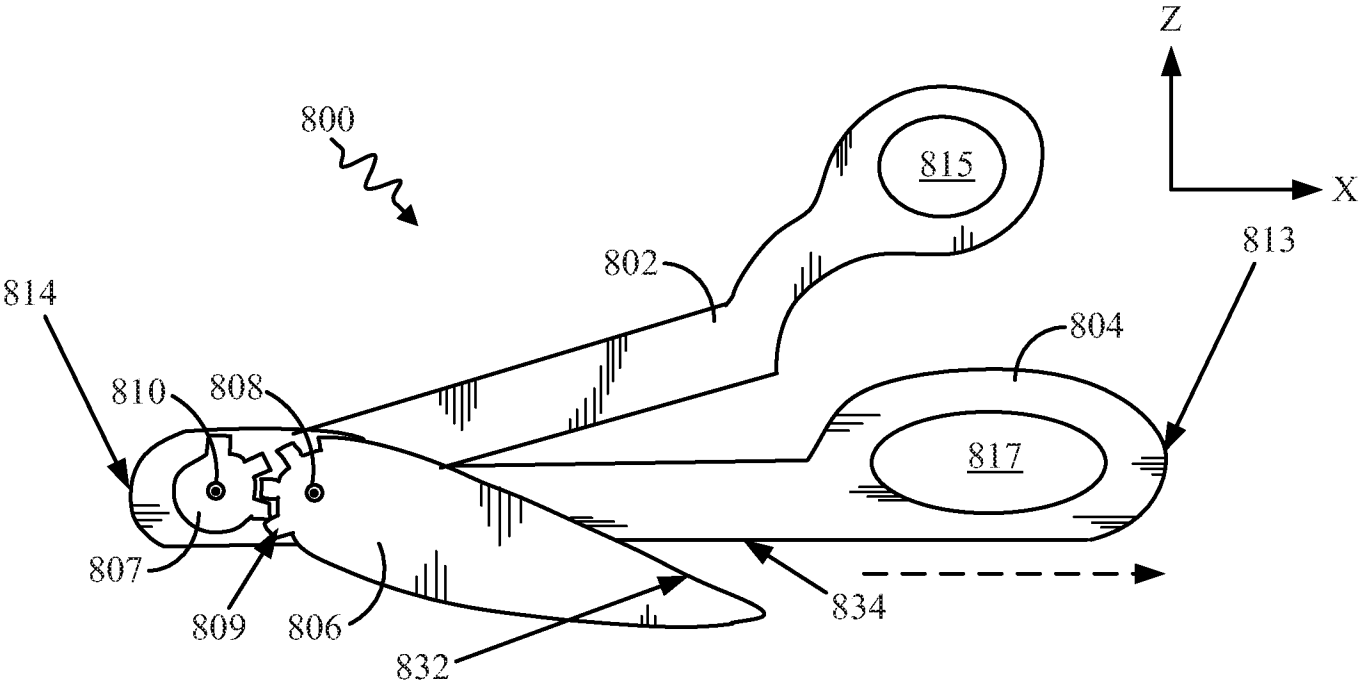
FIG. 8 illustrates a front view of a third aspect of the cutters.
Figure 9:
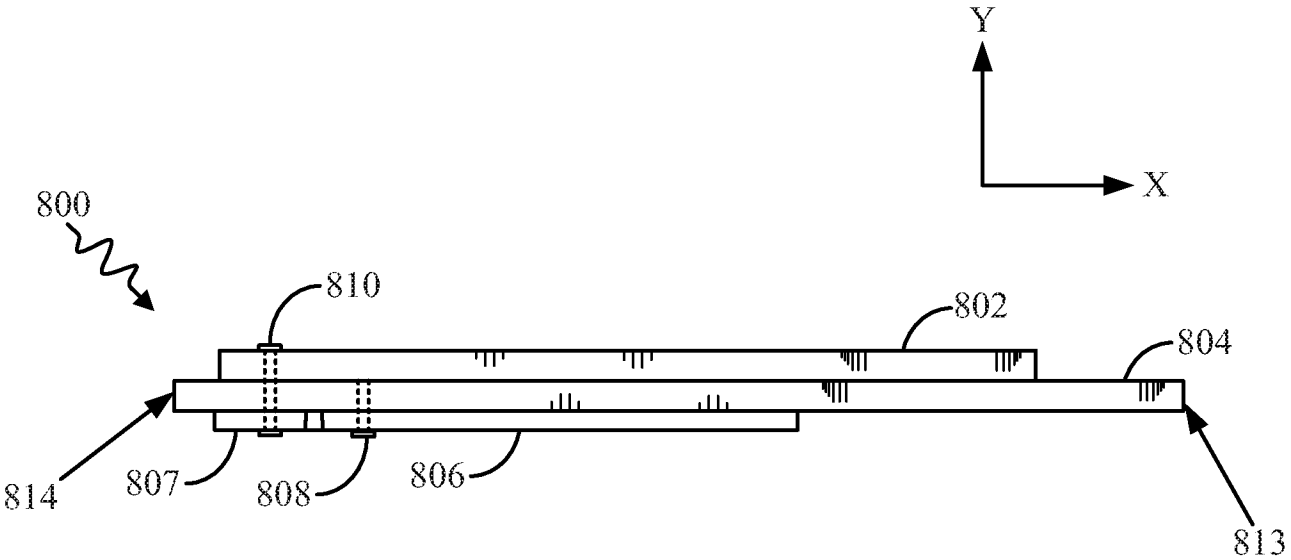
FIG. 9 illustrates a top view of the third aspect of the cutters.

FIGS. 8 and 9 illustrate cutters 800 according to a third aspect of the disclosure. Specifically FIG. 8 illustrates a front view of the cutters 800, and FIG. 9 illustrates a top view of the cutters 800. The cutters 800 may include a first lever 802 (e.g., "top lever"), a second lever 804 (e.g., "bottom lever"), a cutting lever 806, a gear 807 (e.g., "connector" or "third member"), a first member 810 (e.g., "first pivot member" or "first pivot rod"), and a second member 808 (e.g., "second pivot member" or "second pivot rod"). The cutters 800 are operated by moving the top lever 802 and bottom lever 804 toward and away from each other. A user may do that by placing one or more fingers in the finger holes 815, 817 (e.g., "handles") of the top and bottom levers 802, 804 found near a first end 813 of the cutters 800 and spreading their fingers apart and back together. Referring to FIG. 9, the cutters 800 are horizontally-oriented cutters because the top and bottom levers 802, 804 are positioned adjacent to one another in the same horizontal plane (e.g., parallel to X-Y plane).

The first pivot rod 810, located near a second end 814 of the cutters 800, passes through a hole in the gear 807, a hole in the bottom lever 804, and another hole in the top lever 802, thereby coupling the top lever 802 and the gear 807 together. The first pivot rod 810 also rotatably couples the top lever 802 and the bottom lever 804. According to one aspect, the first pivot rod 810 is fixedly attached (e.g., using an adhesive or being welded) to both the top lever 802 and the gear 807. Thus, if the top lever 802 rotates about the first pivot rod 810 so too does the gear 807 in the same direction. The gear 807 mates (e.g., interfaces or engages) with a toothed side 809 (e.g., "toothed portion") of the cutting lever 806, and as the gear 807 rotates in one direction the cutting lever 806 also rotates but in an opposite direction to the gear 807. The second pivot rod 808 passes through a hole in the cutting lever 806 and a hole in the bottom lever 804 thereby coupling the bottom lever and the cutting lever together and allowing the cutting lever 806 to rotate relative to the bottom lever 804 about the second pivot rod 808. The gear 807 alone or the first pivot rod 810 along with the gear 807 may be one example of a means for rotating the cutting lever 806 relative to the bottom lever 804 to move the cutting lever's top edge 832 toward or away from the second lever's bottom edge 834 when the first lever 802 or first handle 815 is moved relative to the second lever 804 or second handle 817.

In one aspect, the pivot rods 808, 810 have one or more securing ends having diameters that are larger than the cross-sectional diameter of the pivot rods 808, 810 in order to secure the pivot rods 808, 810 within the one or more levers 802, 804, 806 and gear 807 and prevent them from falling out. According to one example, the securing ends may be nuts. According to another example where the pivot rods are 808, 810 are screws or bolts, one securing end of each pivot rod 808, 810 may be a screw/bolt head while the other end is a fastening nut. According to yet another example, the pivot rods 808, 810 may be rivets.

Opening the cutters 800 by moving the top lever 802 up and away from the bottom lever 804 causes the gear 807 to rotate (e.g., counterclockwise direction based on cutters' 800 orientation in FIG. 8) about the first pivot rod 810. The rotating gear 807 in turn rotates the cutting lever 806 about the second pivot rod 808 in the opposite direction (e.g., clockwise direction) causing the cutting lever 806 to move away from the bottom lever 804.

Closing the cutters 800 by moving the top lever 802 down and toward the bottom lever 804 causes the gear 807 to rotate (e.g., clockwise direction based on cutters' 800 orientation in FIG. 8) about the first pivot rod 810. The rotating gear 807 in turn rotates the cutting lever 806 about the second pivot rod 808 in the opposite direction (e.g., counterclockwise direction) causing the cutting lever 806, and its top edge 832, to move toward the bottom lever's bottom edge 834. As the cutters 800 are closed, material located between the cutting lever 806 and the bottom lever 804 may be cut if at least one of the cutting lever's top edge 832 or the bottom lever's bottom edge 834 is sharp. The cutters 800 may be pulled in the direction of the dashed arrow (see FIG. 8) while opening and closing the cutters 800 as described above in order to cut additional material. The cutters 800 may also be maneuvered in curved paths while being operated (i.e., opening and closing the cutters 800) to cut curved shapes of material. The material cut can vary widely but may include paper, cardboard, metal, wood, plastic, rubber, etc.

Fourth Aspect

Figure 10:
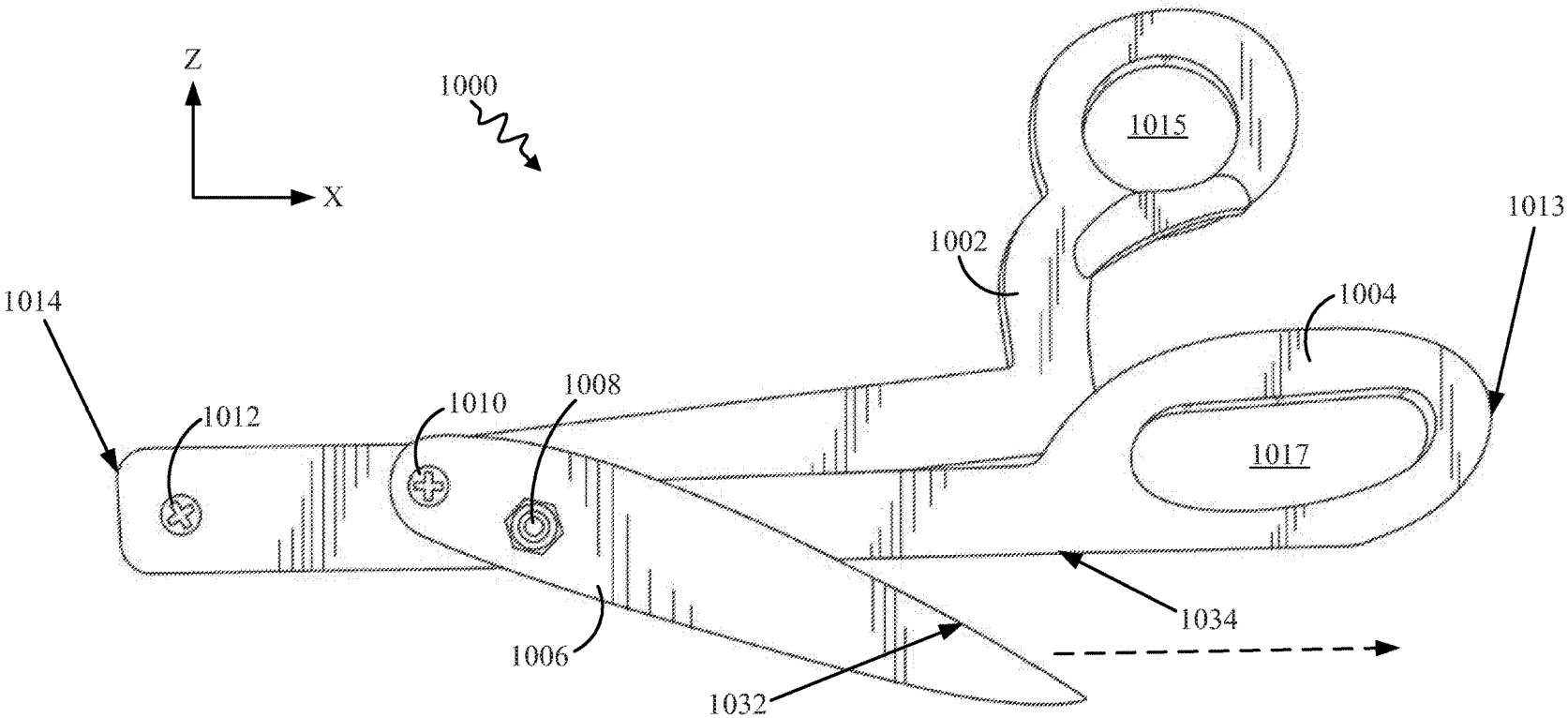
FIG. 10 illustrates a front-perspective view of a fourth aspect of cutters.
Figure 11:
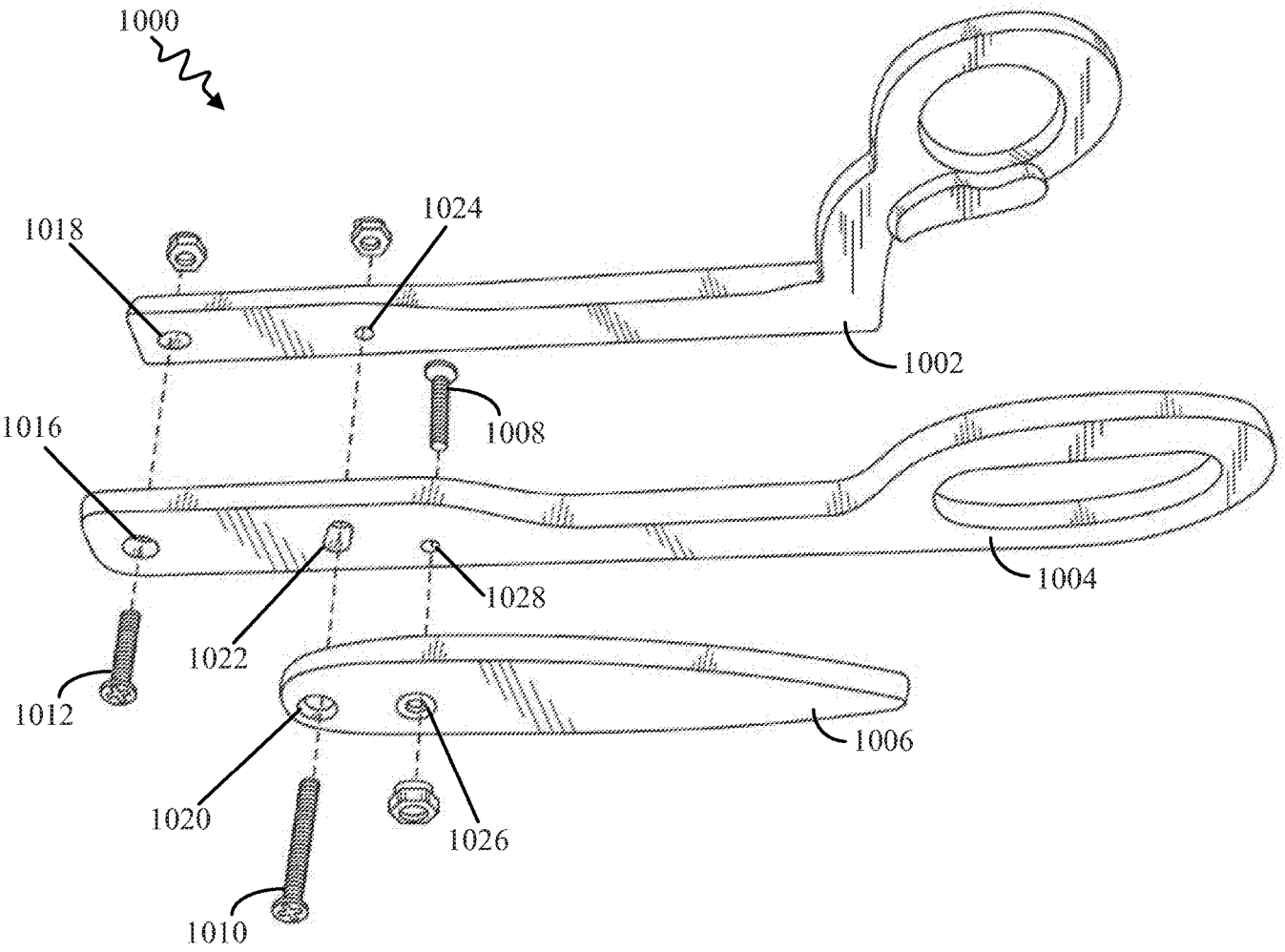
FIG. 11 illustrates a front, exploded view of the fourth aspect of the cutters.
Figure 12:
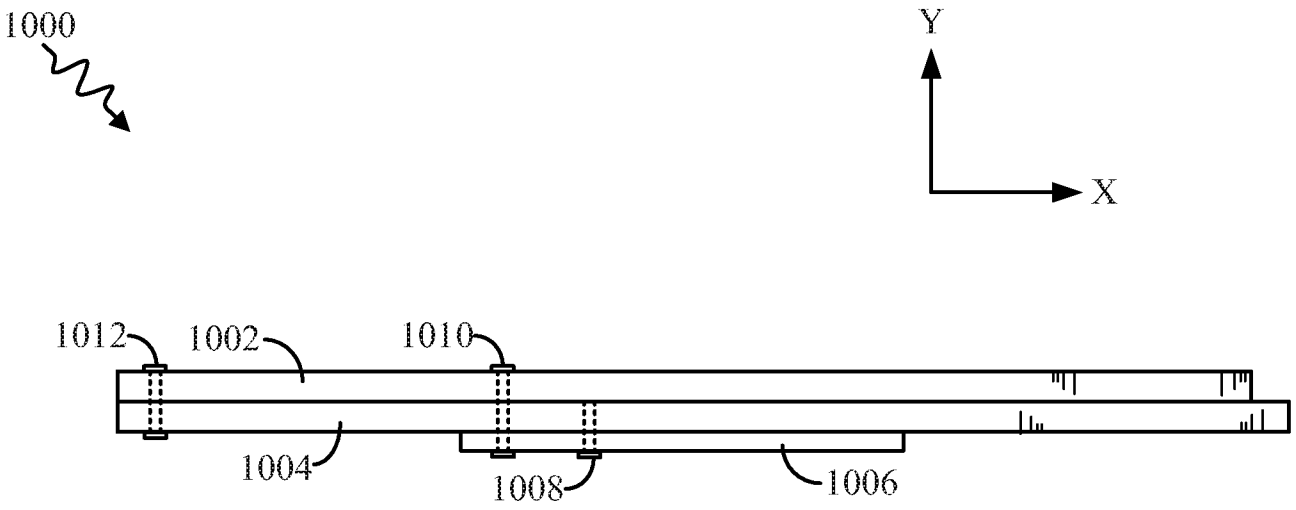
FIG. 12 illustrates a top view of the fourth aspect of the cutters.

FIGS. 10-12 illustrate cutters 1000 according to a fourth aspect of the disclosure. Specifically, FIG. 10 illustrates a front-perspective view of the cutters 1000. FIG. 11 illustrates a front, exploded view of the cutters 1000, and FIG. 12 illustrates a top view of the cutters 1000.

Referring to FIGS. 10, 11, and 12, the cutters 1000 may include a first lever 1002 (e.g., "top lever"), a second lever 1004 ("bottom lever"), a cutting lever 1006, a first member 1012 (e.g., "first pivot member" or "first pivot rod), a second member 1008 (e.g., "second pivot member" or "second pivot rod"), and a third member 1010 (e.g., "connector"). The cutters 1000 are operated by moving the top lever 1002 and bottom lever 1004 toward and away from each other. A user may do that by placing one or more fingers in the finger holes 1015, 1017 (e.g., "handles") of the top and bottom levers 1002, 1004 found near a first end 1013 of the cutters 1000 and spreading their fingers apart. Referring to FIG. 12, the cutters 1000 are horizontally-oriented cutters because the top and bottom levers 1002, 1004 are positioned adjacent to one another in the same horizontal plane (e.g., parallel to X-Y plane).

The first pivot rod 1012, located near a second end 1014 of the cutters 1000, passes through a hole 1016 in the bottom lever 1004 and then through a first slot 1018 (e.g., "first opening") located in the top lever 1002 thereby rotatably coupling the bottom lever 1004 and the top lever 1002 together. The first slot 1018 allows the top lever 1002 to slightly move around relative to the first pivot rod 1012 and the bottom lever 1004. According to one example, the first slot 1018 may instead be a circular hole having a diameter larger than first pivot rod 1012. The connector 1010 passes through a hole 1020 in the cutting lever 1006, a second slot 1022 (e.g., "second opening") located in the bottom lever 1004, and a hole 1024 in the top lever 1002. The connector 1010 rotatably couples the top lever 1002 and the cutting lever 1006 together, and in one aspect the connector 1010 may be one example of a means for rotating the cutting lever 1006 relative to the bottom lever 1004 to move the cutting lever's top edge 1032 toward or away from the second lever's bottom edge 1034 when the first lever 1002 or first handle 1015 is moved relative to the second lever 1004 or second handle 1017. The connector 1010 moves about freely within the second slot 1022. The second pivot rod 1008 passes through a hole 1026 in the cutting lever 1006 and another hole 1028 in the lower lever 1004 thereby rotatably coupling the bottom lever 1004 and the cutting lever 1006 together. According to one aspect, the second slot 1022 may have a curved shape like an arc having an inner side (e.g., intrados) that faces the second end 1014 of the cutters 1000. In other aspects, the second slot 1022 may have another shape including, but not limited to, any elongated shape.

Opening the cutters 1000 by moving the top lever 1002 up and away from the lower lever 1004 causes the top lever 1002 to rotate (e.g., counterclockwise direction based on cutters' 1000 orientation in FIG. 10) about the first pivot rod 1012. It also causes the connector 1010 to move up within the second slot 1022, which in turn causes the cutting lever 1006 to rotate (e.g., clockwise direction based on orientation in FIG. 10) about the second pivot rod 1008. Rotating about the second pivot rod 1008 in this fashion moves the cutting lever's top edge 1032 away from the bottom lever's bottom edge 1034. According to one aspect, at least one of the cutting lever's top edge 1032 or the bottom lever's bottom edge 1034 is sharpened in order to cut material positioned in between the cutting lever 1006 and the bottom lever 1004.

Closing the cutters 1000 by moving the top lever 1002 down and toward the lower lever 1004 causes the top lever 1002 to rotate (e.g., clockwise direction based on cutters' 1000 orientation in FIG. 10) about the first pivot rod 1012. It also causes the connector 1010 to move down within the second slot 1022, which in turn causes the cutting lever 1006 to rotate (e.g., counterclockwise direction based on orientation in FIG. 10) about the second pivot rod 1008. Rotating about the second pivot rod 1008 in this fashion moves the cutting lever's top edge 1032 toward the bottom lever's bottom edge 1034. As the cutters 1000 are closed, material located between the cutting lever 1006 and the bottom lever 1004 may be cut if at least one of the cutting lever's top edge 1032 or the bottom lever's bottom edge 1034 is sharp. The cutters 1000 may be pulled in the direction of the dashed arrow (see FIG. 10) while opening and closing the cutters 1000 as described above in order to cut additional material. The cutters 1000 may also be maneuvered in curved paths while operating the cutters 1000 (i.e., opening and closing the cutters 1000) to cut curved shapes of material. The material cut can vary widely but may include paper, cardboard, metal, wood, plastic, rubber, etc.

Fifth Aspect

Figure 13:
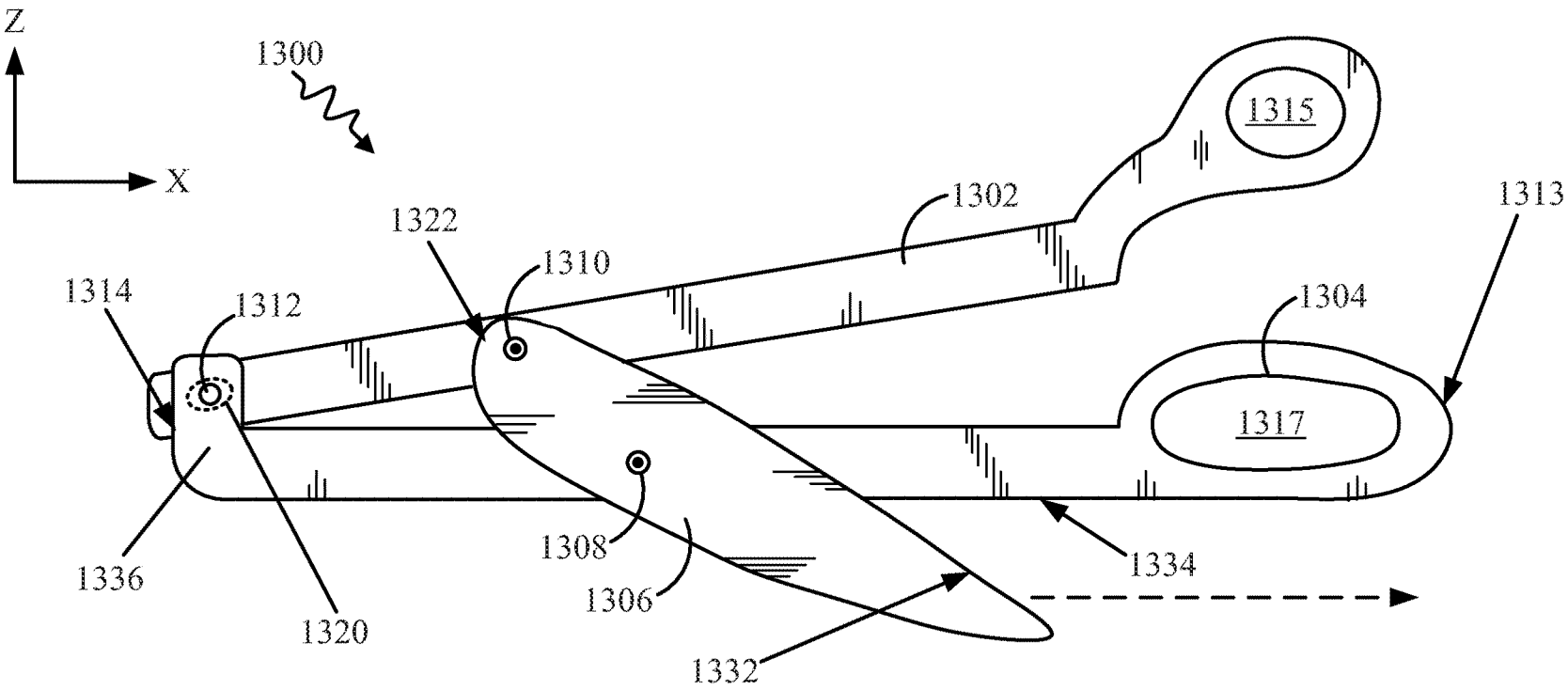
FIG. 13 illustrates a front view of a fifth aspect of cutters.
Figure 14:
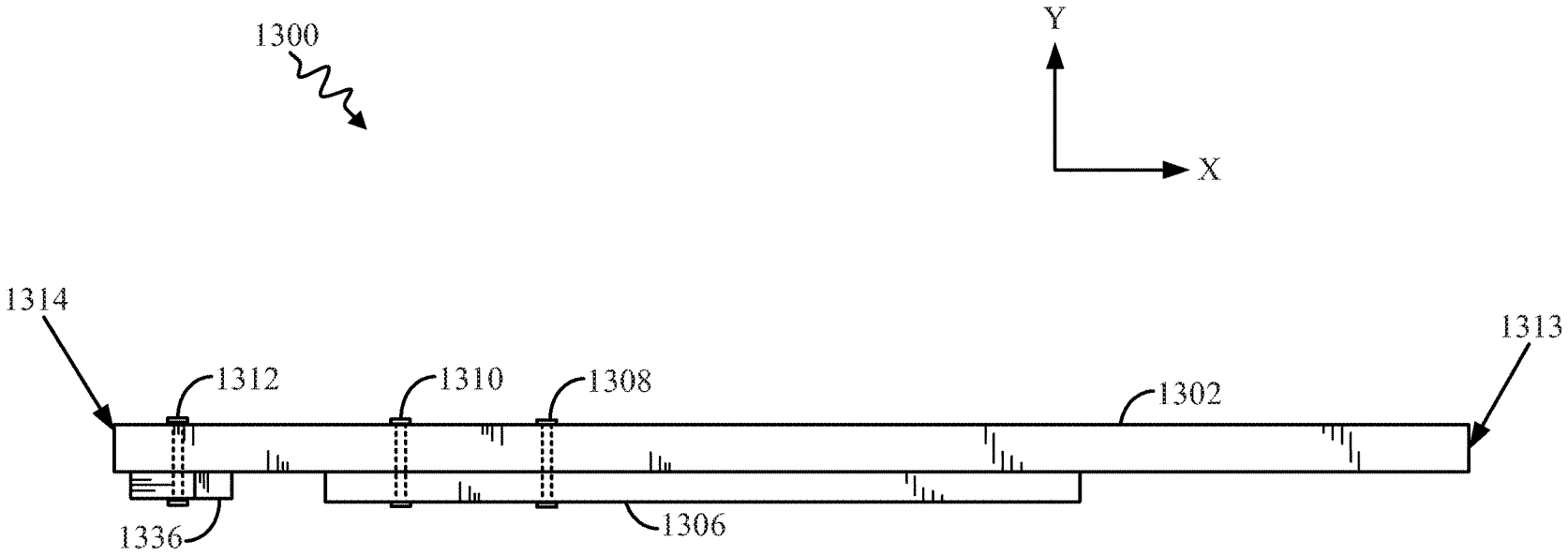
FIG. 14 illustrates a top view of the fifth aspect of the cutters.
Figure 15:
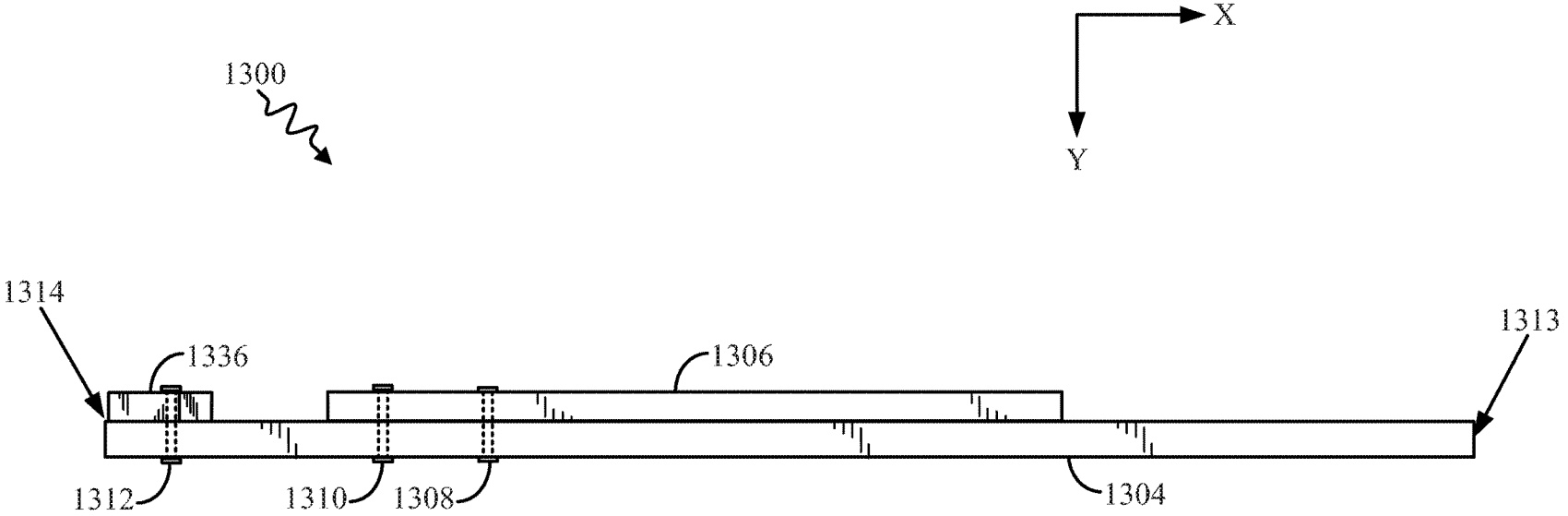
FIG. 15 illustrates a bottom view of the fifth aspect of the cutters.

FIGS. 13-15 illustrate cutters 1300 according to a fifth aspect of the disclosure. Specifically, FIG. 13 illustrates a front view of the cutters 1300, FIG. 14 illustrates a top view of the cutters 1300, and FIG. 15 illustrates a bottom view of the cutters 1300.

Referring to FIG. 13, the cutters 1300 may include a first lever 1302 (e.g., "top lever"), a second lever 1304 ("bottom lever"), a cutting lever 1306, a first pivot member 1308 (e.g., "first member" or "first pivot rod"), a second pivot member 1310 (e.g., "second member" or "second pivot rod"), a third pivot member 1312 (e.g., "third member" or "third pivot rod"), and a connecting piece 1336. The cutters 1300 are operated by moving the top lever 1302 and bottom lever 1304 toward and away from each other. A user may do that by placing one or more fingers in the finger holes 1315, 1317 (e.g., "handles") of the top and bottom levers 1302, 1304 found near a first end 1313 of the cutters 1300 and spreading their fingers apart. Referring to FIGS. 13-15, the cutters 1300 may be considered "vertically-oriented cutters" in that the top and bottom levers 1302, 1304 are positioned in the same vertical plane (e.g., parallel to X-Z plane).

Referring to FIG. 13, the third pivot rod 1312, located near a second end 1314 of the cutters 1300, passes through a hole in the connecting piece 1336 and then through a first slot 1320 (e.g., "first opening") located in the top lever 1302, thereby rotatably coupling the top lever 1302 to the connecting piece 1336. Since the connecting piece 1336 is fixedly coupled to the bottom lever 1304, and in some aspects it may actually be a part of the bottom lever 1304, the third pivot rod 1312 effectively rotatably couples the top lever 1302 to the bottom lever 1304. The first slot 1320 allows the top lever 1302 to move relative to the third pivot rod 1312 and the bottom lever 1304. The second pivot rod 1310 passes through a hole at about a first end 1322 of the cutting lever 1306 and also through a hole in the top lever 1302 thereby coupling the top lever 1302 and the first end 1322 of the cutting lever 1306 together. The first pivot rod 1308 passes through another hole in the cutting lever 1306 and also through a hole in the bottom lever 1304 thereby coupling the bottom lever 1304 and the cutting lever 1306 together. According to one aspect, the first slot 1320 may instead be a circular hole and the hole in the top lever 1302 through which the second pivot rod 1310 passes through may instead be a slot (e.g., opening).

Opening the cutters 1300 by moving the top lever 1302 up and away from the lower lever 1304 causes the top lever 1302 to move relative to the third pivot rod 1312 and the bottom lever 1304 (e.g., for the orientation of the cutters 1300 shown in FIG. 13 the top lever 1302 slides in the direction of the dashed arrow). Opening the cutters 1300 also causes the top lever 1302 to pull the second pivot rod 1310 up and away from the bottom lever 1304, thereby causing the cutting lever 1306 to rotate (e.g., clockwise direction based on orientation shown in FIG. 13) about the first pivot rod 1308. Rotating about the first pivot rod 1308 in this fashion moves the cutting lever's top edge 1332 away from the bottom lever's bottom edge 1334. According to one aspect, at least one of the cutting lever's top edge 1332 or the bottom lever's bottom edge 1334 is sharpened in order to cut material positioned in between the cutting lever 1306 and the bottom lever 1304.

Closing the cutters 1300 by moving the top lever 1302 down and toward the lower lever 1304 causes the top lever 1302 to move relative to the third pivot rod 1312 and the bottom lever 1304 in the opposite direction (e.g., for the orientation of the cutters 1300 shown in FIG. 13 the top lever 1302 slides in the opposite direction of the dashed arrow). This also causes the top lever 1302 to push the second pivot rod 1310 down and toward the bottom lever 1304, thereby causing the cutting lever 1306 to rotate (e.g., counterclockwise direction based on orientation shown in FIG. 13) about the first pivot rod 1308. Rotating about the first pivot rod 1308 in this fashion moves the cutting lever's top edge 1332 toward the bottom lever's bottom edge 1334. As the cutters 1300 are closed, material located between the cutting lever 1306 and the bottom lever 1304 may be cut if at least one of the cutting lever's top edge 1332 or the bottom lever's bottom edge 1334 is sharp. The cutters 1300 may be pulled in the direction of the dashed arrow while opening and closing the cutters 1300 as described above in order to cut additional material. The cutters 1300 may also be maneuvered in curved paths while operating the cutters 1300 (i.e., opening and closing the cutters 1000) to cut curved shapes of material. The material cut can vary widely but may include paper, cardboard, metal, wood, plastic, rubber, etc.

Sixth Aspect

Figure 16:
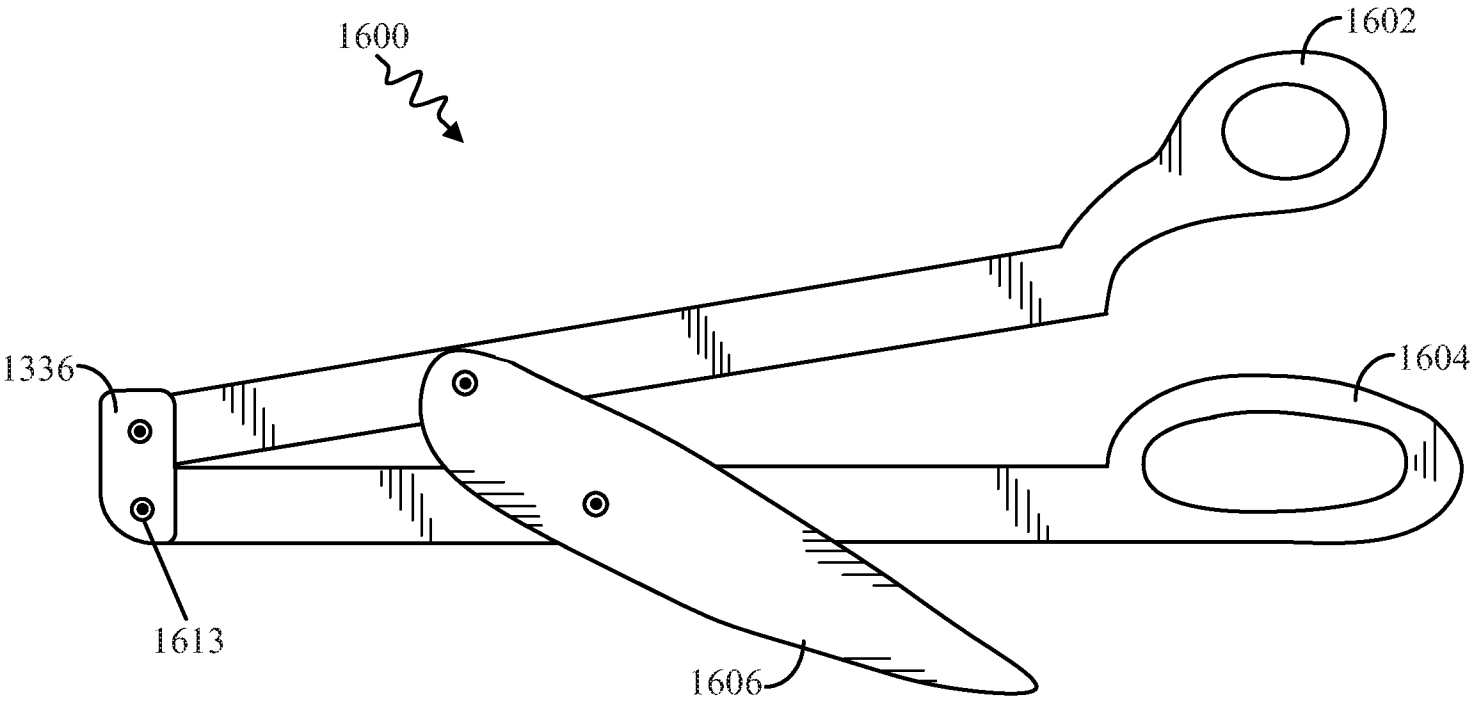
FIG. 16 illustrates cutters according to a sixth aspect.

FIG. 16 illustrates cutters 1600 according to a sixth aspect of the disclosure. Specifically, FIG. 16 illustrates a front view of the cutters 1600. The cutters 1600 shown in FIG. 16 is similar to the cutters 1300 shown in FIGS. 13-15 except that the cutters 1600 shown in FIG. 16 includes a fourth pivot rod (e.g., "fourth member" or "fourth pivot member") 1613 that passes through another hole in the connecting piece and through a hole in the cutters' bottom lever 1604. This allows the connecting piece 1336 to rotatably couple with respect to the bottom lever 1604 instead of being fixedly coupled to the bottom lever 1604. The top lever 1602 of the cutters 1600 shown in FIG. 16 also does not have or need a first slot 1320 and may be instead replaced by a circular shaped hole.

Additional Features

Figure 17:
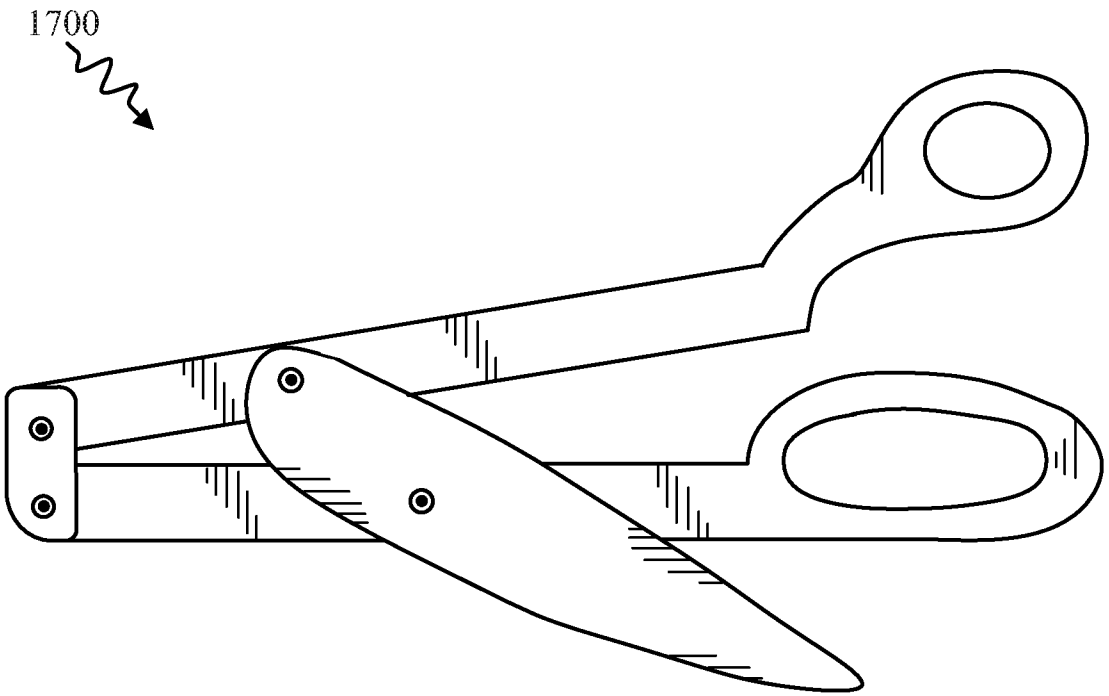
FIG. 17 illustrates exemplary cutters that can be shortened and made more compact.

FIG. 17 illustrates how one or more of the cutters 100, 600, 800, 1000, 1300, 1600 described herein can be shortened and made more compact. In the illustrated example, the cutters 1700 are a compact version of the cutters 1600 shown in FIG. 16. Similarly, cutters 100, 600, 800, 1000, 1300, 1600 described herein can be made significantly larger so that two hands are needed for operation.

Figure 18:
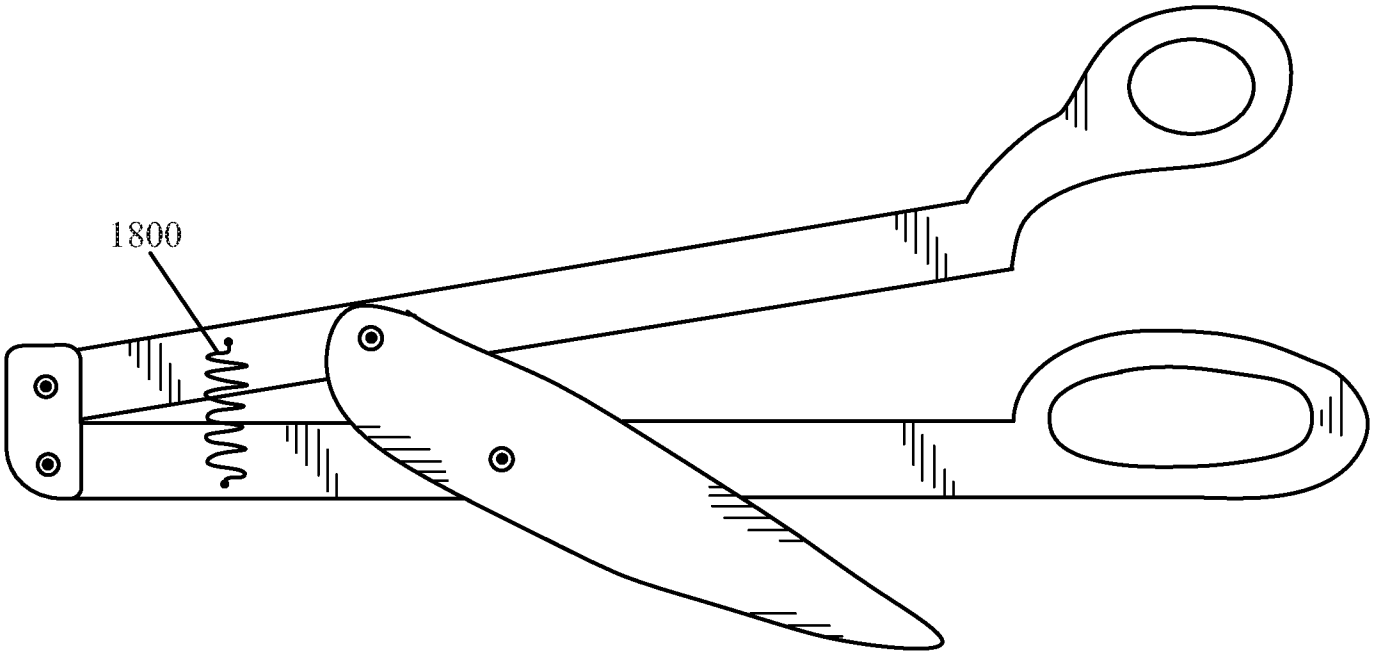
FIG. 18 illustrates exemplary cutters modified with a spring that adds force when cutting material.

FIG. 18 illustrates how one or more of the cutters 100, 600, 800, 1000, 1300, 1600 described herein can be modified with a spring 1800 in order to add force when cutting material.

Figure 19:
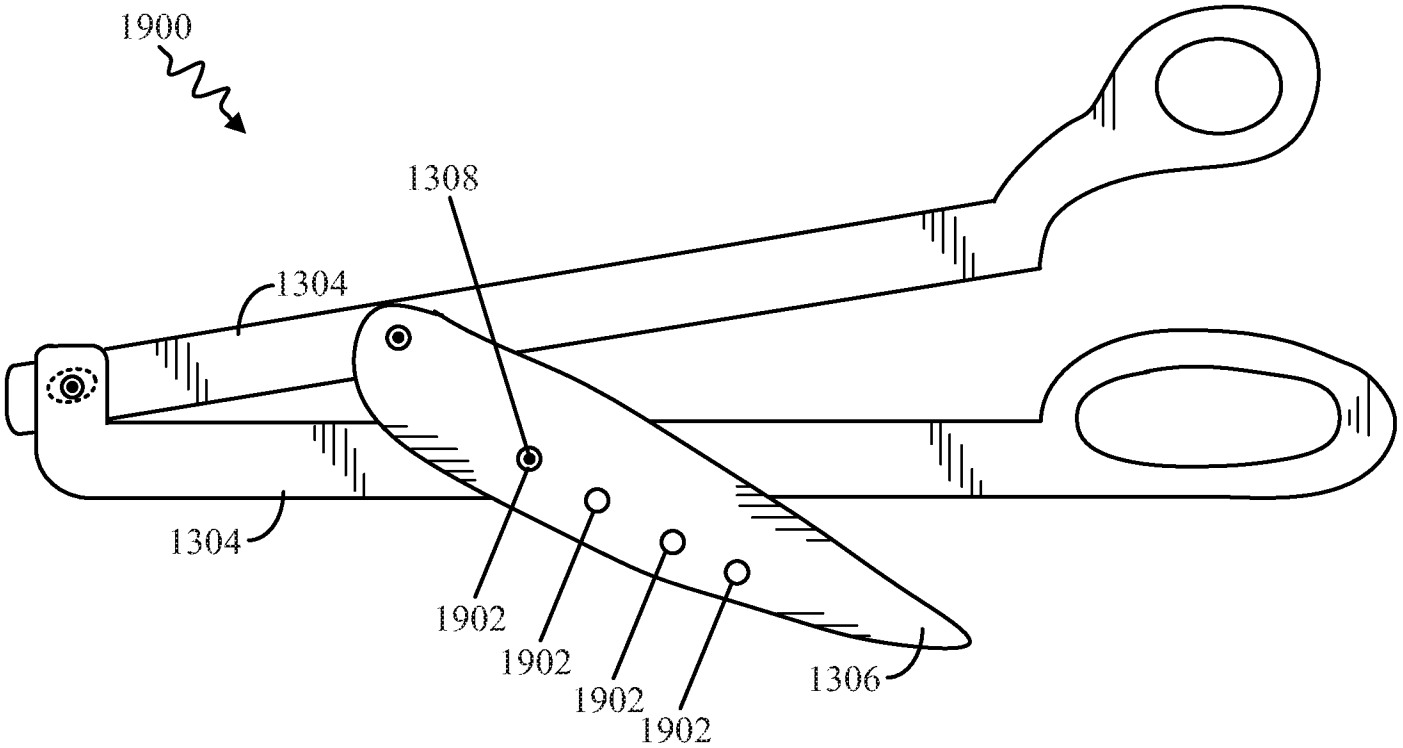
FIG. 19 illustrates first exemplary cutters having adjustable leverage.

FIG. 19 illustrates how the cutters 1300 shown and described with respect to FIGS. 13-15 can be modified to have adjustable leverage. Specifically, the cutting lever 1306 and the bottom lever 1304 may be modified to include a plurality of pivot holes 1902 where the first pivot rod 1308 may be moved from one pivot hole 1902 to another 1902 to change the leverage supplied by the cutters 1900. The cutters 100, 1600 shown in FIGS. 1 and 16 may similarly be modified.

Figure 20:
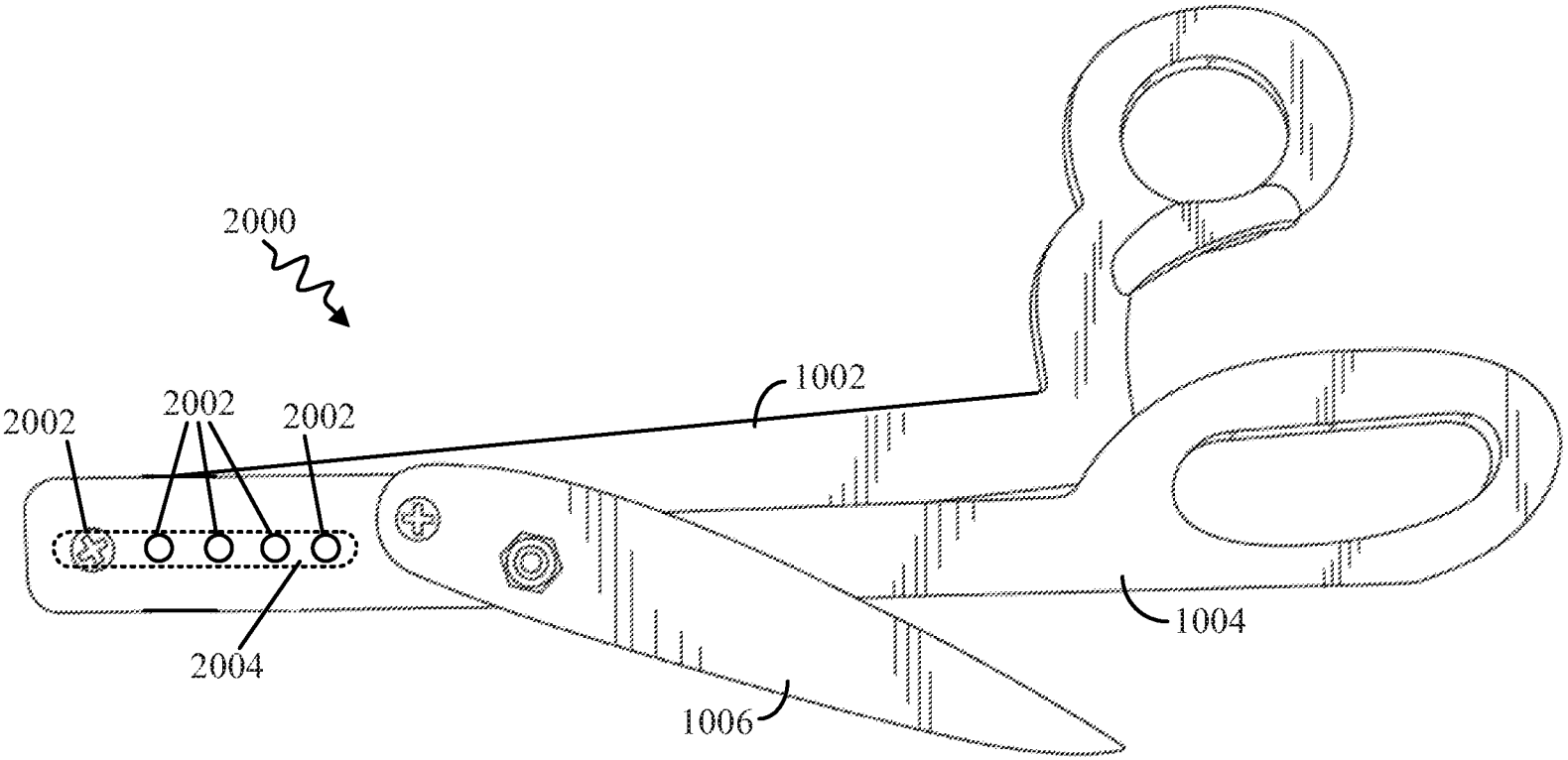
FIG. 20 illustrates second exemplary cutters having adjustable leverage.

FIG. 20 illustrates how the cutters 1000 shown and described with respect to FIGS. 10-12 can be modified to have adjustable leverage. Specifically, the bottom lever 1004 may be modified by adding a plurality of pivot holes 2002 as shown. The top lever 1002 may be modified to include an elongated opening 2004 (e.g., slot). The first pivot rod 1012 may then be moved to different pivot holes 2002 to change the leverage supplied by the cutters 2000. The cutters 100 shown in FIG. 1 may similarly be modified.

Seventh Aspect

Figure 21:
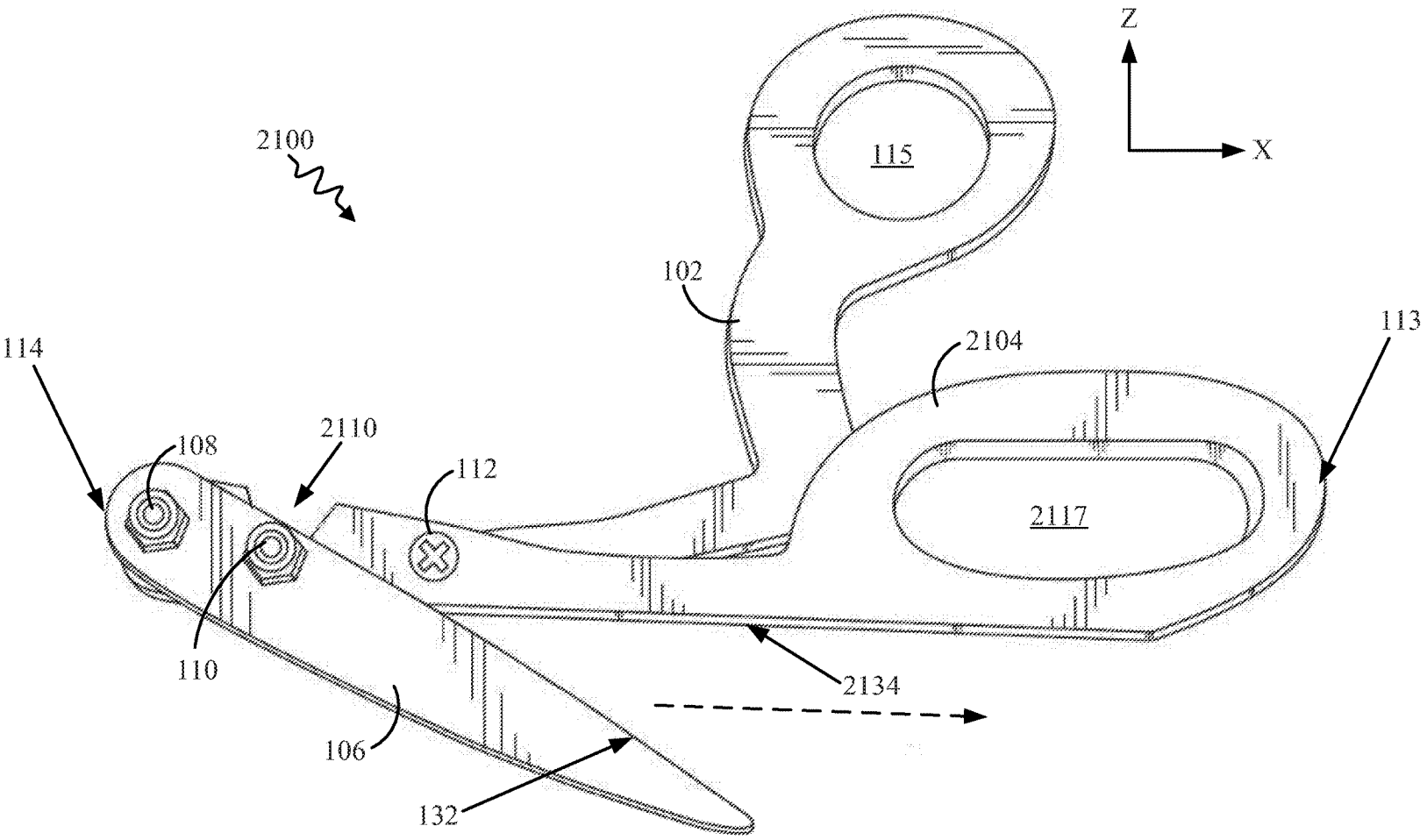
FIG. 21 illustrates a front-perspective view of the cutters according to a seventh aspect in an open position.
Figure 22:
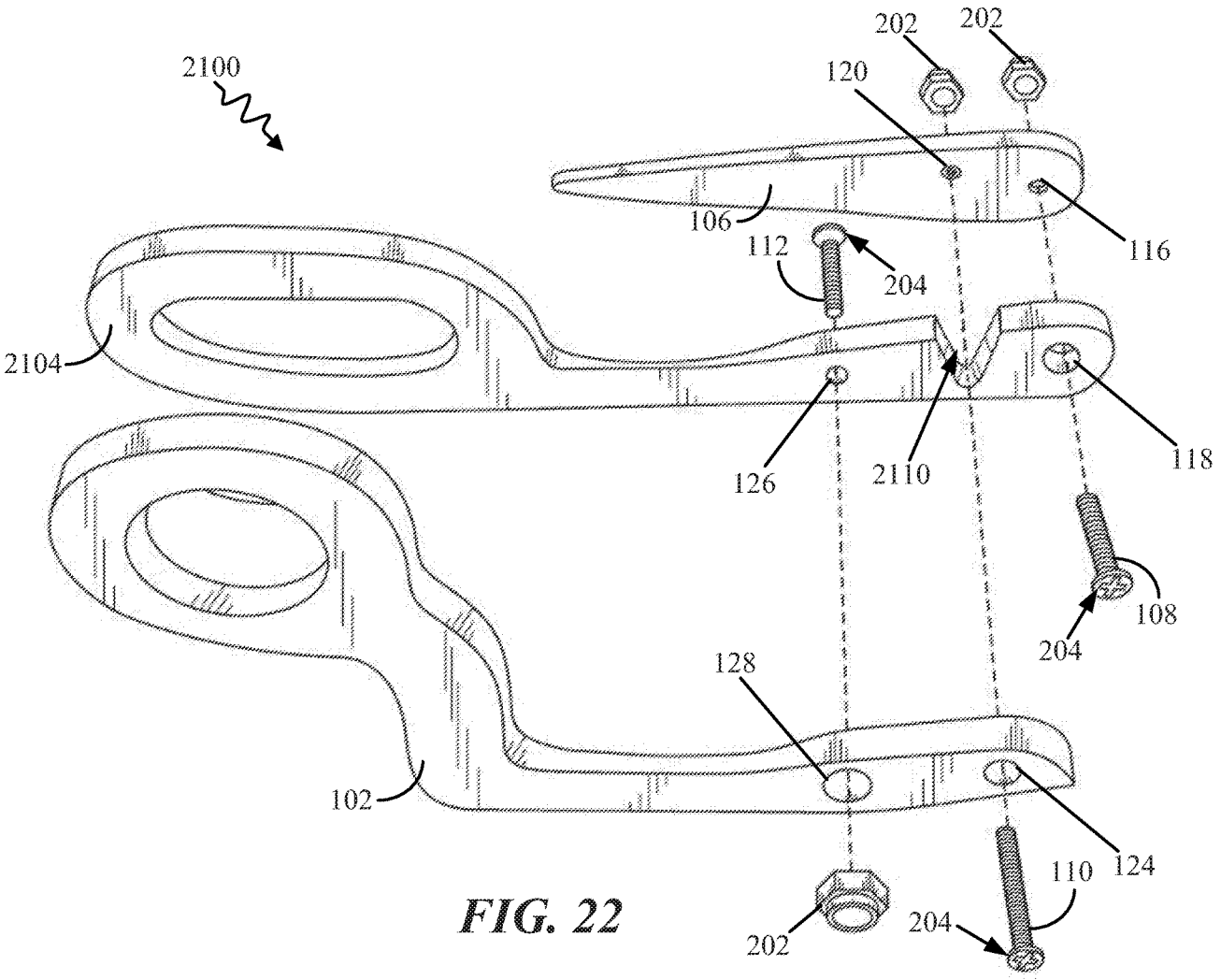
FIG. 22 illustrates a rear, exploded view of the seventh aspect of the cutters.
Figure 23:
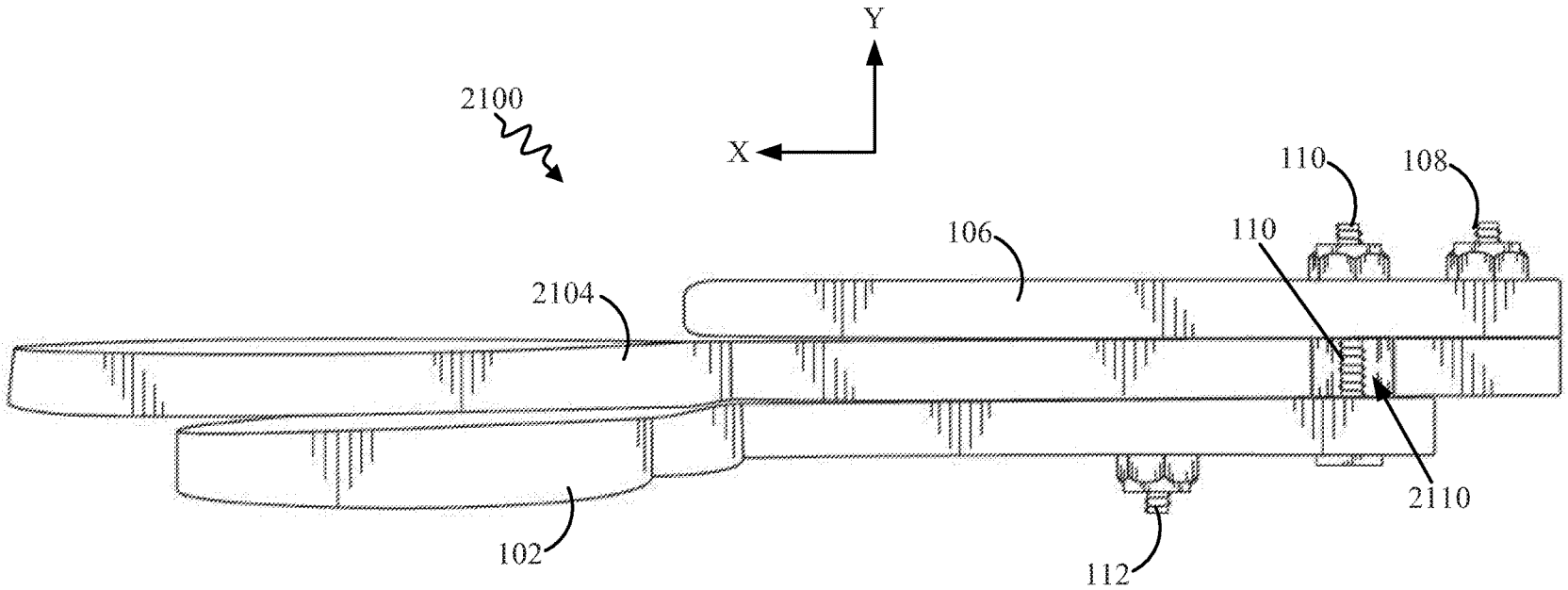
FIG. 23 illustrates a top view of the seventh aspect of the cutters.

FIGS. 21-23 illustrate cutters 2100 according to seventh aspect of the disclosure. Specifically, FIG. 21 illustrates a front-perspective view of the cutters 2100 in an open position. FIG. 22 illustrates a rear, exploded view of the cutters 2100. FIG. 23 illustrates a top view of the cutters 2100, respectively.

The cutters shown in FIGS. 21-23 are identical to the cutters 100 shown in FIGS. 1-5 except that the second lever 2104 (e.g., "bottom lever") includes an indentation 2110 that allows the third member 110 to pass by (bypass) the second lever 2104 as the third member 110 couples the top lever 102 to the cutting lever 106. The third member 110 may be one example of a means for rotating the cutting lever 106 relative to the second lever 2104 to move the cutting lever's top edge 132 toward or away from the second lever's bottom edge 2134 when the first lever 102 or first handle 115 is moved relative to the second lever 2104 or second handle 2117. Thus, the cutters 2100 shown in FIGS. 21-23 do not include the slot/opening 122 (see FIG. 2) and the third member 110 does not pass directly through the second lever 2104. Notwithstanding these differences, the cutters 2100 of FIGS. 21-23 operate substantially the same as those shown and described above with respect to FIGS. 1-5.

Eighth Aspect

Figure 24:
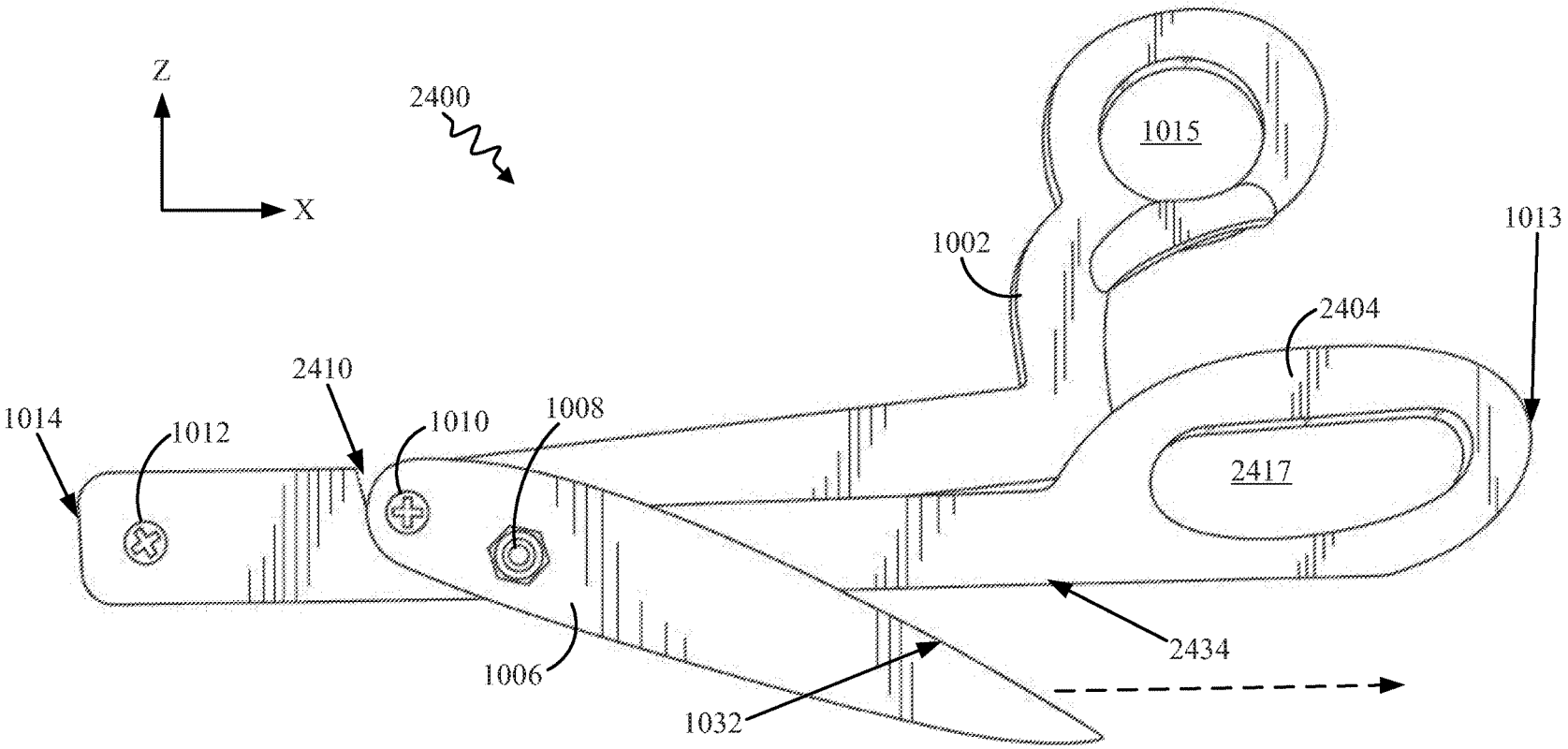
FIG. 24 illustrates a front-perspective view of an eighth aspect of the cutters in an open position.
Figure 25:
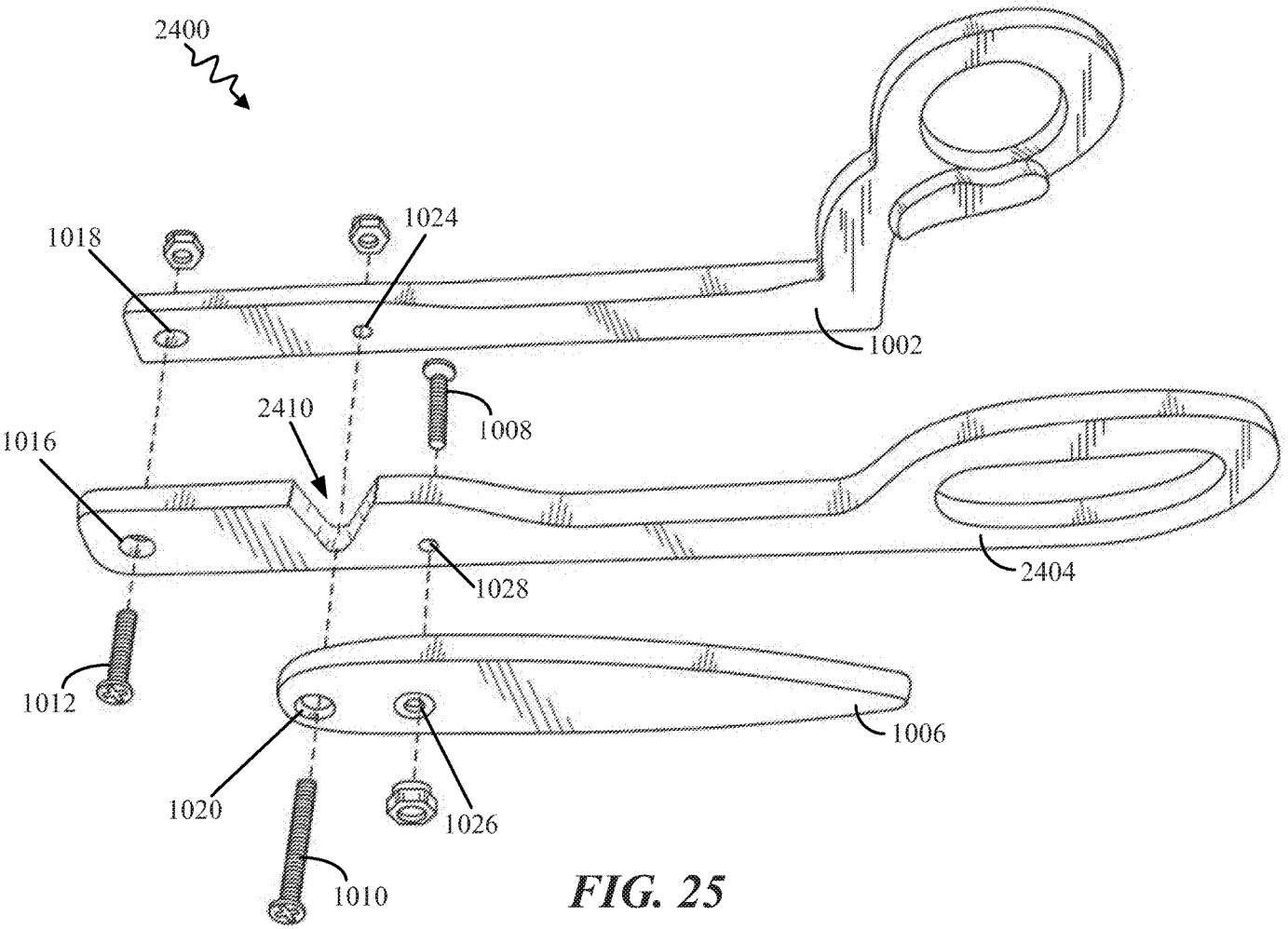
FIG. 25 illustrates a rear, exploded view of the eighth aspect of the cutters.
Figure 26:
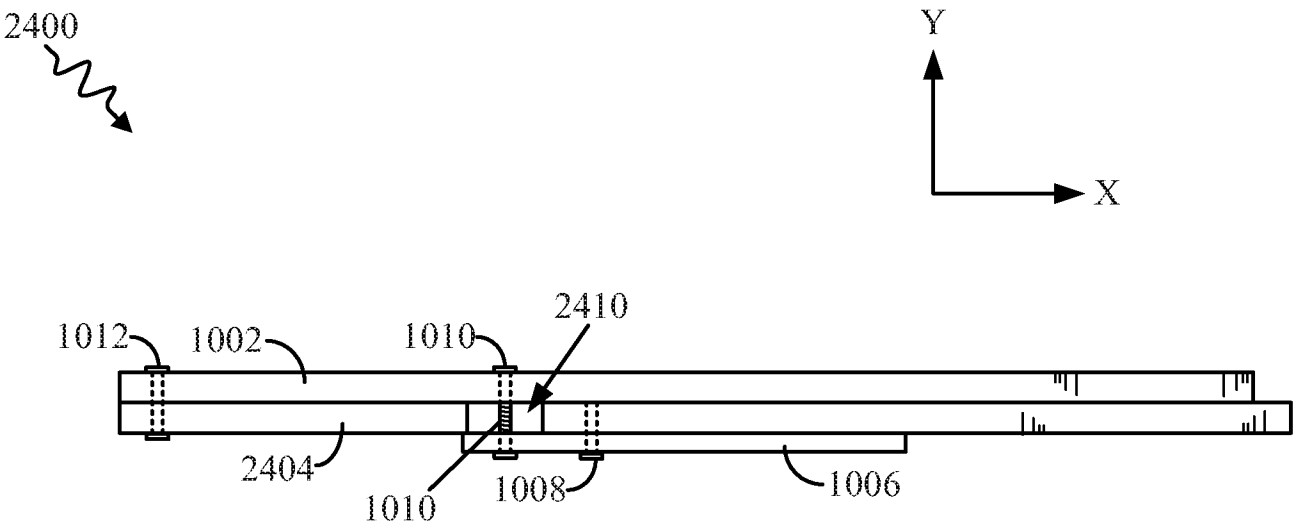
FIG. 26 illustrates a top view of the eighth aspect of the cutters.

FIGS. 24-26 illustrate cutters 2400 according to an eighth aspect of the disclosure. Specifically, FIG. 24 illustrates a front-perspective view of the cutters 2400 in an open position. FIG. 25 illustrates a front, exploded view of the cutters 2400. FIG. 26 illustrates a top view of the cutters 2400, respectively.

The cutters shown in FIGS. 24-26 are identical to the cutters 1000 shown in FIGS. 10-12 except that the second lever 2404 (e.g., "bottom lever") includes an indentation 2410 that allows the third member 1010 to pass by (bypass) the second lever 2404 as the third member 1010 couples the top lever 1002 to the cutting lever 1006. The third member 1010 may be one example of a means for rotating the cutting lever 1006 relative to the second lever 2404 to move the cutting lever's top edge 1032 toward or away from the second lever's bottom edge 2434 when the first lever 1002 or first handle 1015 is moved relative to the second lever 2404 or second handle 2417. Thus, the cutters 2400 shown in FIGS. 24-26 do not include the slot/opening 1022 (see FIG. 11) and the third member 1010 does not pass directly through the second lever 2404. Notwithstanding these differences, the cutters 2400 of FIGS. 24-26 operate substantially the same as those shown and described with respect to FIGS. 10-12.

Ninth Aspect

Figure 27:
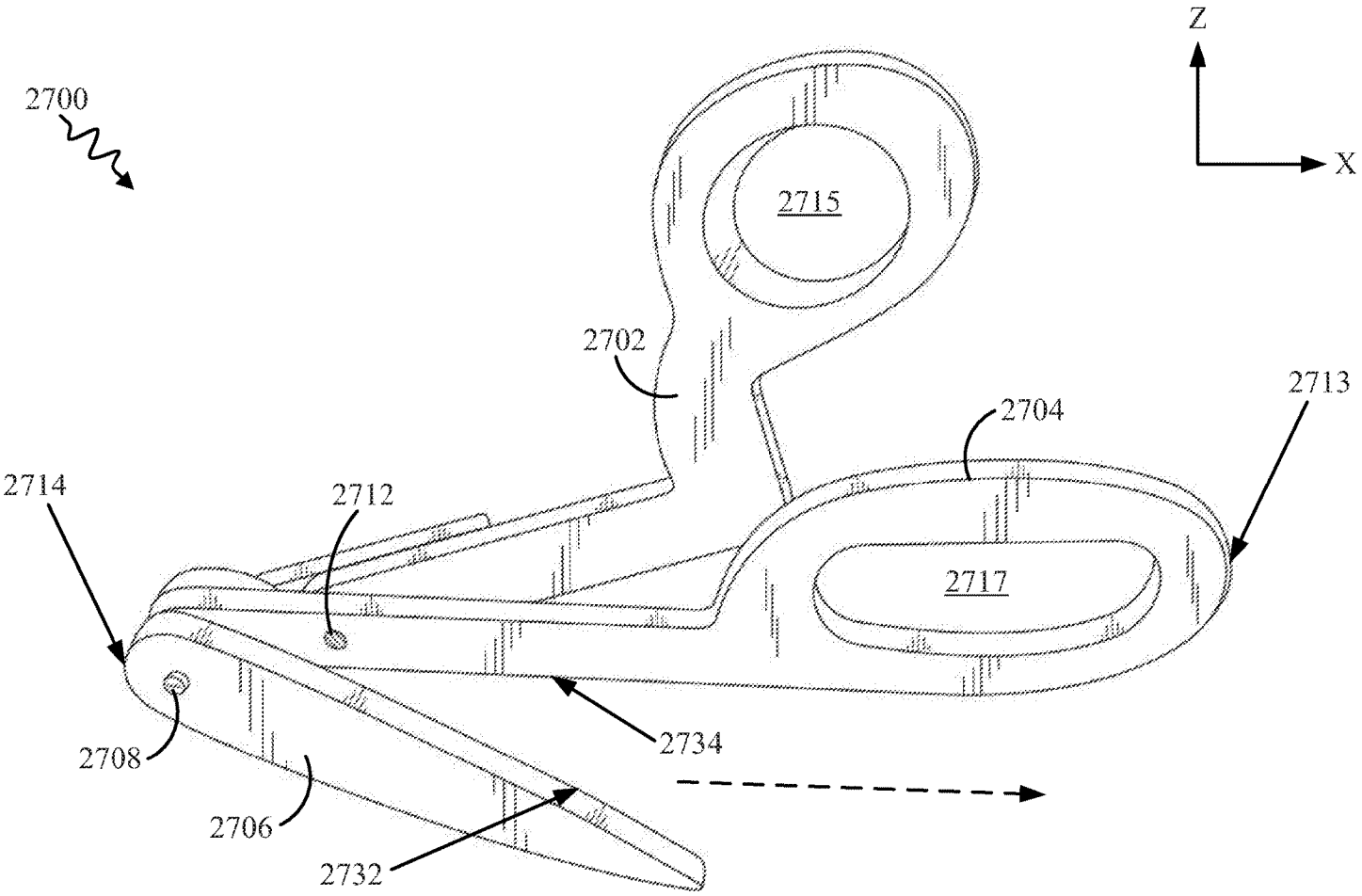
FIG. 27 illustrates a front-perspective view a ninth aspect of the cutters in an open position.
Figure 28:
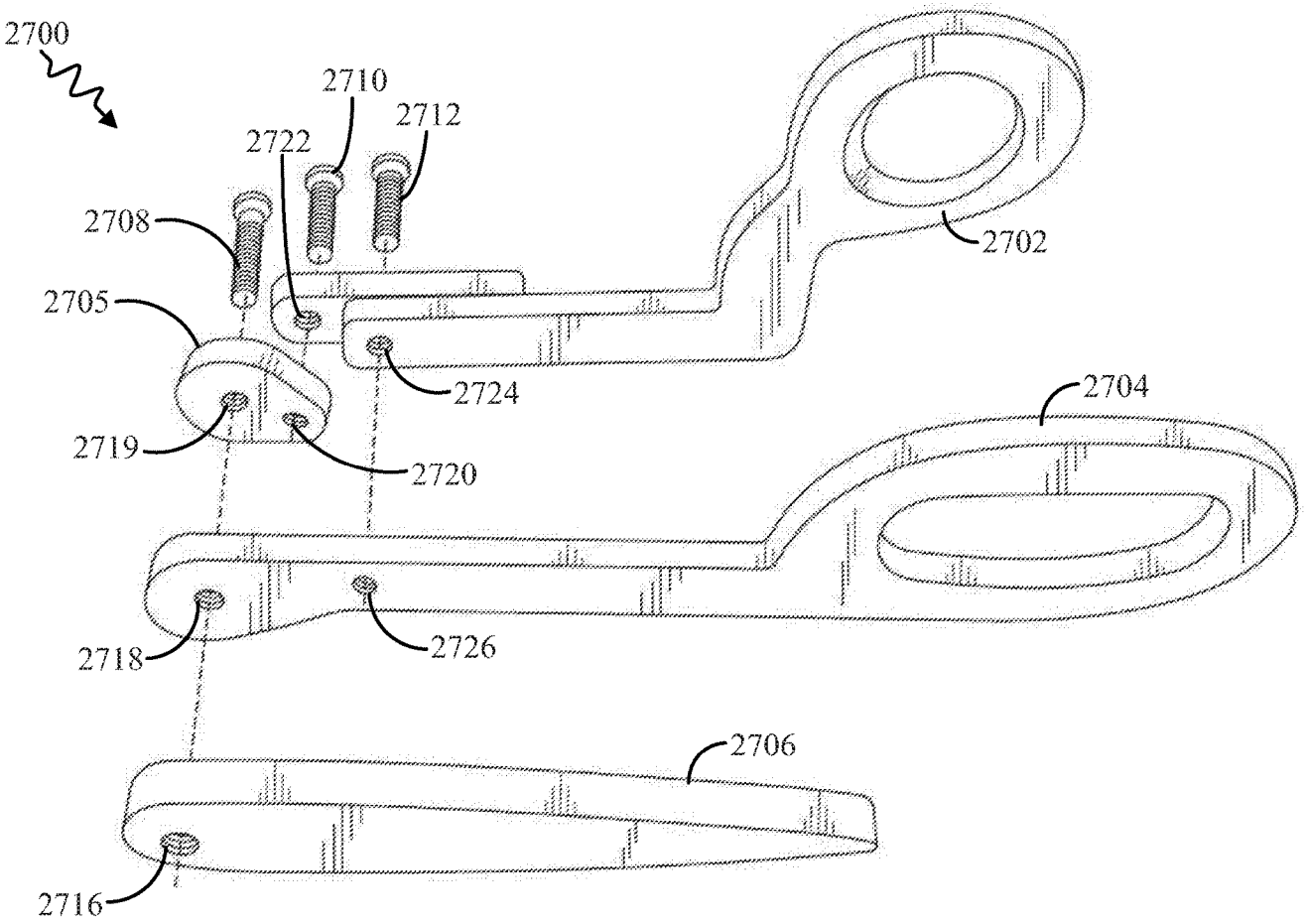
FIG. 28 illustrates a front, exploded view of the ninth aspect of the cutters.
Figure 29:
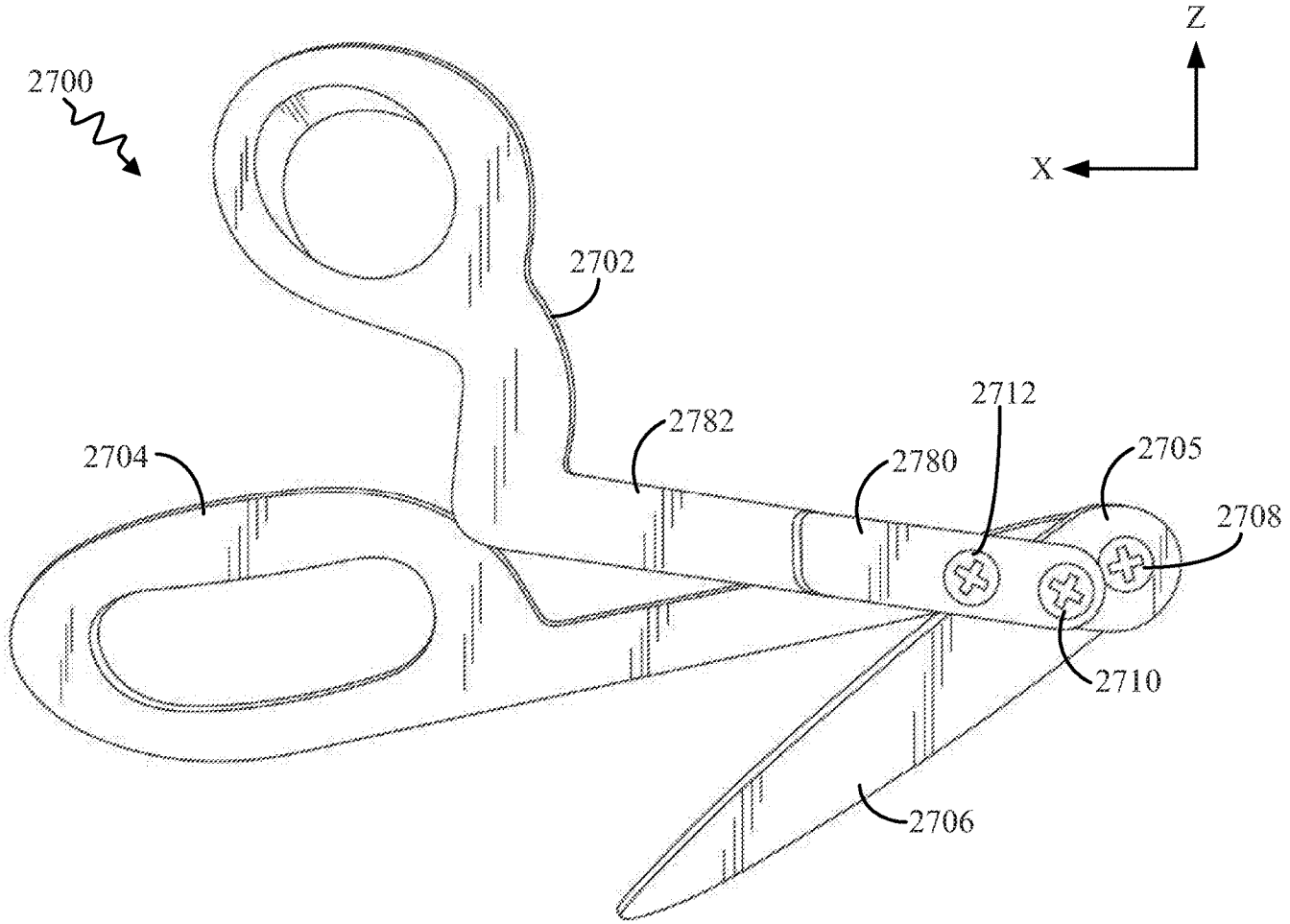
FIG. 29 illustrates a rear-perspective view of the ninth aspect of the cutters.
Figure 30:
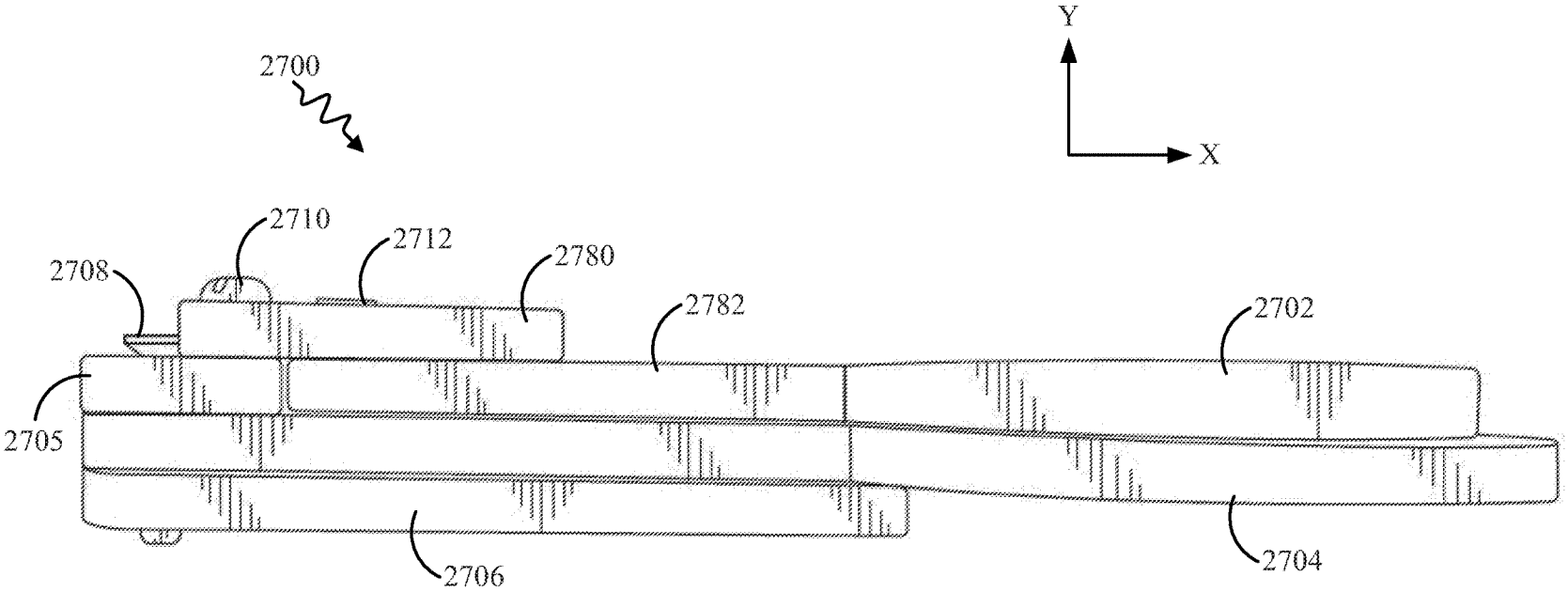
FIG. 30 illustrates a top view of the ninth aspect of the cutters.

FIGS. 27-30 illustrate cutters 2700 according to a ninth aspect of the disclosure. Specifically, FIG. 27 illustrates a front-perspective view of the cutters 2700 in an open position. FIG. 28 illustrates a front, exploded view of the cutters 2700. FIGS. 29 and 30 illustrate a rear-perspective view and a top view of the cutters 2700, respectively. The cutters 2700 may include a first lever 2702 (e.g., "top lever"), a second lever 2704 (e.g., "bottom lever"), a third lever 2705 (e.g., "coupling lever"), a cutting lever 2706, a first member 2712 (e.g., "first pivot member" or "first pivot rod"), a second member 2708 (e.g., "second pivot member" or "second pivot rod"), and a third member 2710 (e.g., "connector"). The top lever 2702 includes a connecting portion 2780 (e.g., "arm") that has a length parallel to the length of the top member's main portion 2782 but that is offset with respect to the main portion 2782 in the y-axis' direction (see FIG. 30). In one aspect the connecting portion 2780 and the top lever 2702 may all be one single piece. In another aspect, the connecting piece 2780 is a separate piece from the top lever 2702 that is, for example, coupled to the main portion 2782 by the first pivot member 2712.

The cutters 2700 are operated by moving the top lever 2702 and bottom lever 2704 toward and away from each other. A user may do that by placing one or more fingers in the finger holes 2715, 2717 (e.g., "handles") of the top and bottom levers 2702, 2704 found near a first end 2713 of the cutters 2700 and spreading their fingers apart and back together. When the top lever 2702 and bottom lever 2704 are pulled apart/away from one another the cutters 2700 are in the open position. By contrast, when the top lever 2702 and bottom lever 2704 are moved towards each other the cutters 2700 are in the closed position. Referring to FIG. 30, the cutters 2700 may be considered "horizontally-oriented cutters" in that the top and bottom levers 2702, 2704 are positioned adjacent to one another in the same horizontal plane (e.g., parallel to X-Y plane).

Referring to FIGS. 27 and 28, the second member 2708, located near a second end 2714 of the cutters 2700, passes through a hole 2716 in the cutting lever 2706, a hole 2718 in the bottom lever, and a hole 2719 in the coupling lever 2705 to couple the coupling lever 2705 and the cutting lever 2706 together. The second member 2708 may be fixedly coupled to the cutting lever 2706 and the coupling lever 2705 by various means including, but not limited to, adhesive. In one aspect, the second member 2708 may be welded to the coupling lever 2705 and the cutting lever 2706. Since the coupling lever 2705 and the cutting lever 2706 may be fixedly attached to the second member 2708, rotating the coupling lever 2705 causes the second member 2708 to rotate the cutting lever 2706 with respect to the bottom lever 2704.

The third member 2710 passes through a first opening 2722 (e.g., "slot") in the top lever 2702 and through a second opening 2720 located in the coupling lever 2705. The third member 2710 couples the top lever 2702 and the coupling lever 2705 together. The third member 2710 may move about freely within at least one of the first opening 2722 or the second opening 2720. The first member 2712 passes through a hole 2724 in the top lever 2702 and also through a hole 2726 located in the bottom lever 2704. In one aspect, at least one of the first opening 2722 or the second opening 2720 may be circular with a diameter at least 0.5 millimeters (mm) larger than the diameter of the third member 2710. In other aspects, at least one of the first opening 2722 or the second opening 2720 may have another shape including, but not limited to, other elongated shapes such as an oval. In one aspect, the third member 2710 alone or in combination with the coupling lever 2705 may be one example of a means for rotating the cutting lever 2706 relative to the second lever 2704 to move the cutting lever's top edge 2732 toward or away from the second lever's bottom edge 2734 when the first lever 2702 or first handle 2715 is moved relative to the second lever 2704 or second handle 2717.

In one aspect, one or more of the members 2708, 2710, 2712 may have one or more securing ends having diameters that are larger than their cross-sectional diameter in order to secure the one or more members 2708, 2710, 2712 within the one or more levers 2702, 2704, 2705, 2706 and prevent them from falling out. According to one example, the securing ends may be fastening nuts. According to another example where the members 2708, 2710, 2712 are screws or bolts, one securing end of each member 2708, 2710, 2712 may be a screw/bolt head. According to yet another example, one or more of the members 2708, 2710, 2712 may be rivets. According to yet another example, the one or more members 2708, 2710, 2712 may not have securing ends and may simply be rods.

Opening the cutters 2700 by moving the top lever 2702 up and away from the bottom lever 2704 causes the top lever 2702 to rotate in a counterclockwise direction (e.g., based on cutters' 2700 orientation in FIG. 27) about the first member 2712. It also causes the third member 2710 to move down and in a counterclockwise direction, which in turn causes the coupling lever 2705 and the second member 2708 to rotate clockwise (e.g., based on orientation in FIG. 27). (Based on the orientation of the cutters in FIG. 29, the third member 2710 would move in a clockwise direction.) Rotating the second member 2708 in this fashion also causes the cutting lever 2706 and its top edge 2732 to rotate clockwise and away from the bottom lever's bottom edge 2734. As described below, at least one of the cutting lever's top edge 2732 or the bottom lever's bottom edge 2734 may be relatively sharp in order to cut material positioned in between the cutting lever 2706 and the bottom lever 2704.

Closing the cutters 2700 by moving the top lever 2702 back towards the bottom lever 2704 causes the top lever 2702 to rotate in a clockwise direction (e.g., based on cutters' 2700 orientation in FIG. 27) about the first member 2712. It also causes the third member 2710 to move up and in a clockwise direction, which in turn causes the coupling lever 2705 and the first pivot rod 2708 to rotate counterclockwise (e.g., based on orientation in FIG. 27). (Based on the orientation of the cutters in FIG. 29, the third member 2710 would move in a counterclockwise direction.) Rotating the second member 2708 in this fashion causes the cutting lever 2706 and its top edge 2732 to rotate counterclockwise and toward the bottom lever's bottom edge 2734. As the cutters 2700 are closed, material located between the cutting lever 2706 and the bottom lever 2704 may be cut if at least one of the cutting lever's top edge 2732 or the bottom lever's bottom edge 2734 are sharp enough. The cutters 2700 may be pulled in the direction of the dashed arrow (see FIG. 27) while opening and closing the cutters 2700 as described above in order to cut additional material. The cutters 2700 may also be maneuvered in curved paths while being operated (i.e., opening and closing the cutters 2700) to cut curved shapes of material. The material cut can vary widely but may include paper, cardboard, metal, wood, plastic, rubber, etc.

Tenth Aspect

Figure 31:
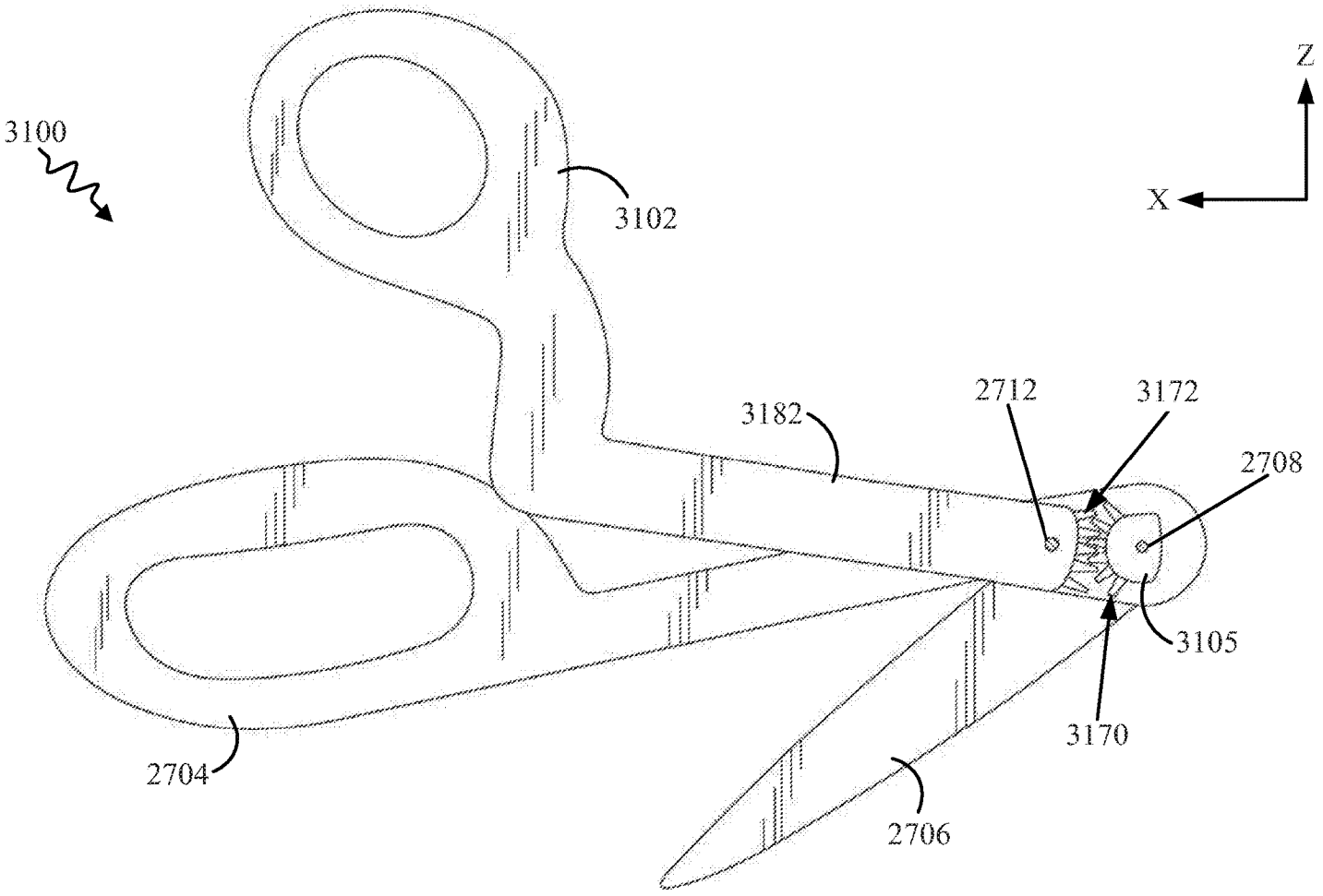
FIG. 31 illustrates a rear view of a tenth aspect of the cutters in an open position.
Figure 32:
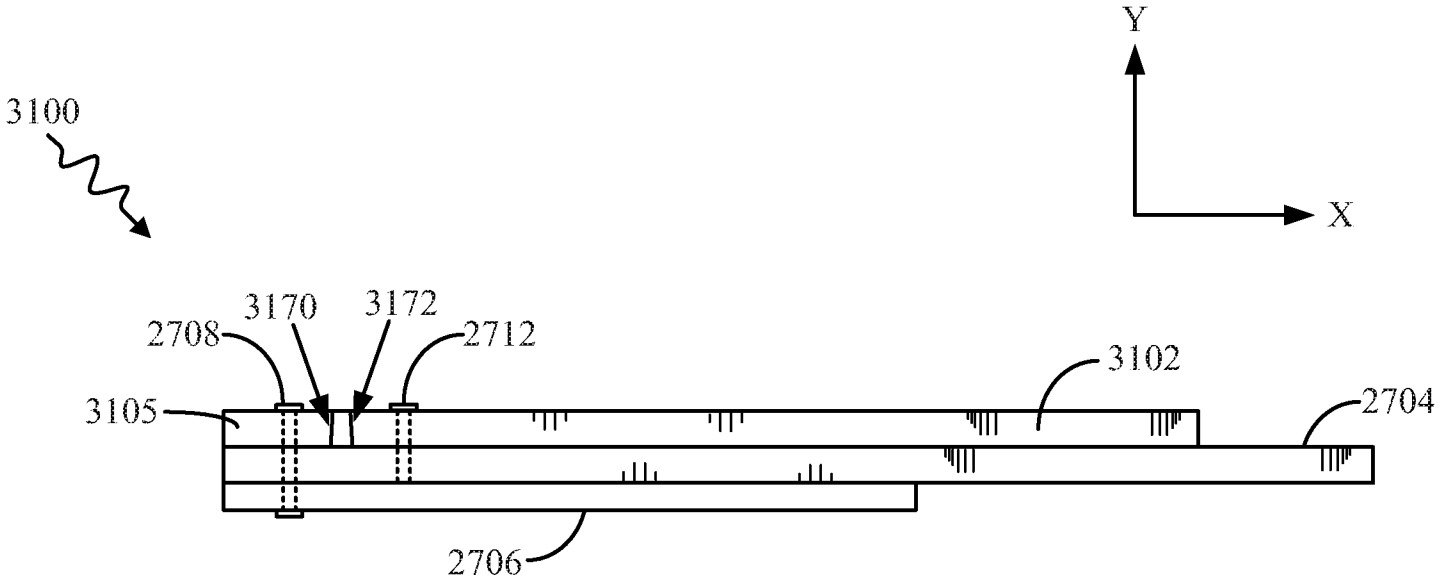
FIG. 32 illustrates a top view of the tenth aspect of the cutters.

FIGS. 31 and 32 illustrate cutters 3100 according to a tenth aspect of the disclosure. Specifically, FIG. 31 illustrates a rear view of the cutters 3100 in an open position. FIG. 32 illustrates a top view of the cutters 3100. The cutters 3100 shown in FIGS. 31 and 32 are substantially similar to the cutters 2700 shown and described in FIGS. 27-30 except for the differences described below.

The coupling lever 3105 (e.g., "gear") of the cutters 3100 in FIGS. 31 and 32 includes teeth 3170 that mate (e.g., interface or engage) with a toothed end 3172 of the top lever's 3102 main portion 3182. Thus, the top lever's toothed end 3172 allows the top lever 3102 to directly couple/engage with the coupling lever 3105, and consequently the arm 2780 and third member 2710 shown in FIG. 29 are unnecessary. Opening the cutters 3100 by moving the top lever 3102 up and away from the bottom lever 2704 causes the top lever 3102 to rotate in a clockwise direction (e.g., based on cutters' 3100 orientation in FIG. 31) about the first member 2712, which in turn causes the coupling lever 3105 and the second member 2708 to rotate counterclockwise (e.g., based on orientation in FIG. 31) since the coupling lever's teeth 3170 engage with the top lever's toothed end 3172. Similarly, closing the cutters 3100 by moving the top lever 3102 down and toward the bottom lever 2704 causes the top lever 3102 to rotate in a counterclockwise direction about the first member 2712, which in turn causes the coupling lever 3105 and the second member 2708 to rotate clockwise. As described above with respect to FIGS. 27-30, when the second member 2708 rotates, so too does the cutting lever 2706 allowing material placed between the cutting lever's top edge 2732 and the bottom lever's bottom edge 2734 to be cut. In one aspect, the coupling lever 3105 may be one example of a means for rotating the cutting lever 2706 relative to the second lever 2704 to move the cutting lever's top edge 2732 toward or away from the second lever's bottom edge 2734 when the first lever 2702 or first handle 2715 is moved relative to the second lever 2704 or second handle 2717.

Eleventh Aspect

Figure 33:
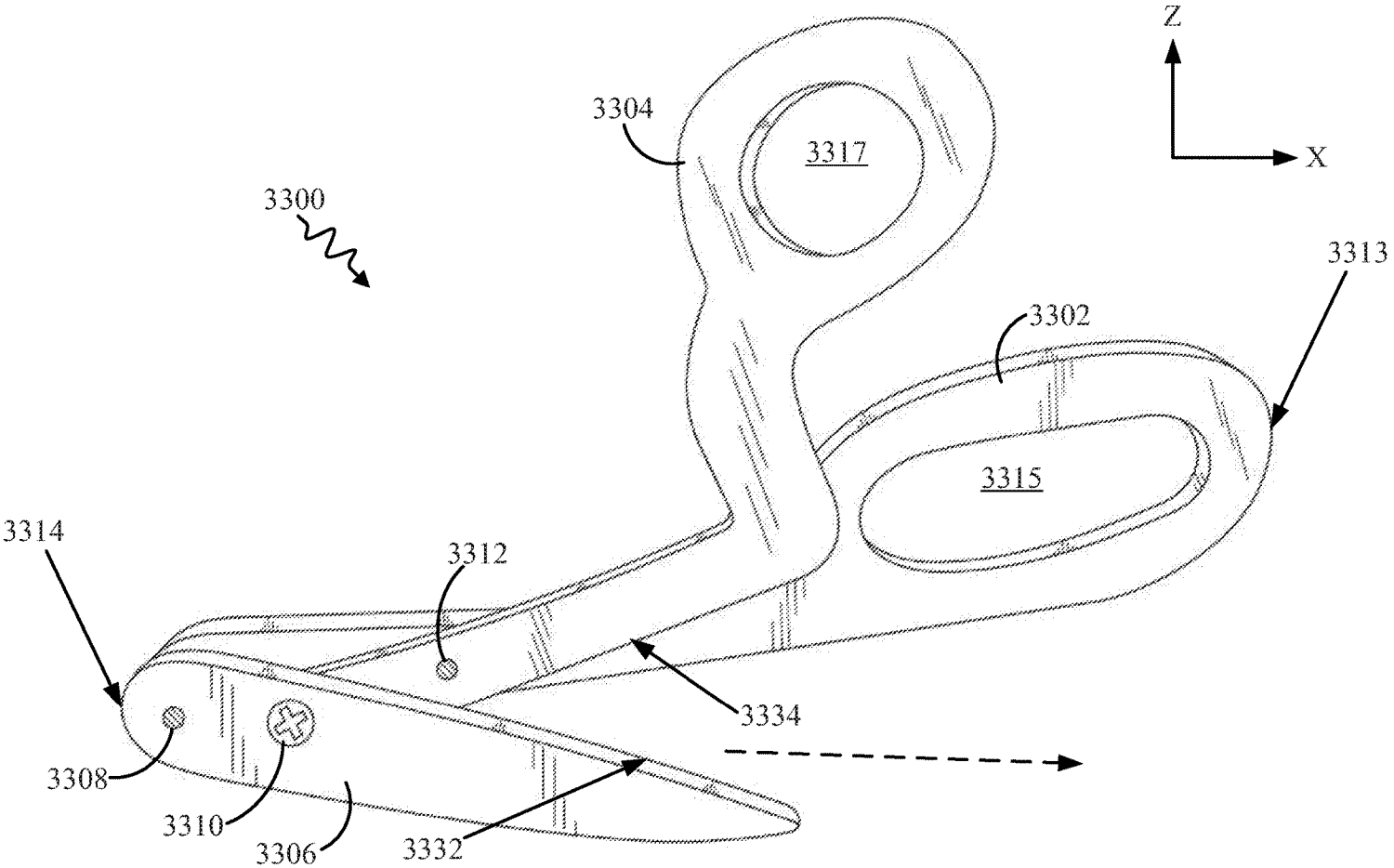
FIG. 33 illustrates a front-perspective view of an eleventh aspect of the cutters in an open position.
Figure 34:
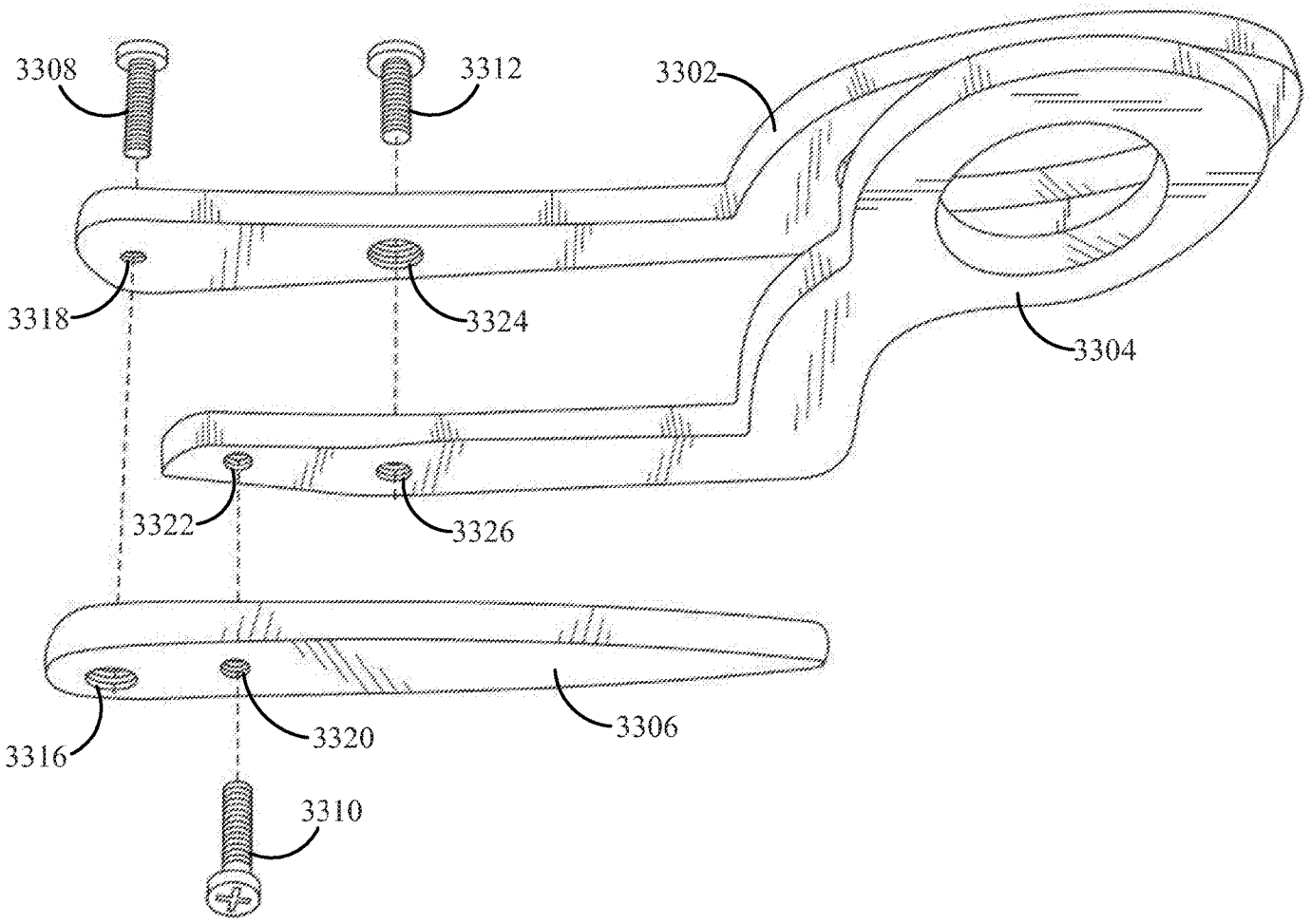
FIG. 34 illustrates a front, exploded view of the eleventh aspect of the cutters.
Figure 35:
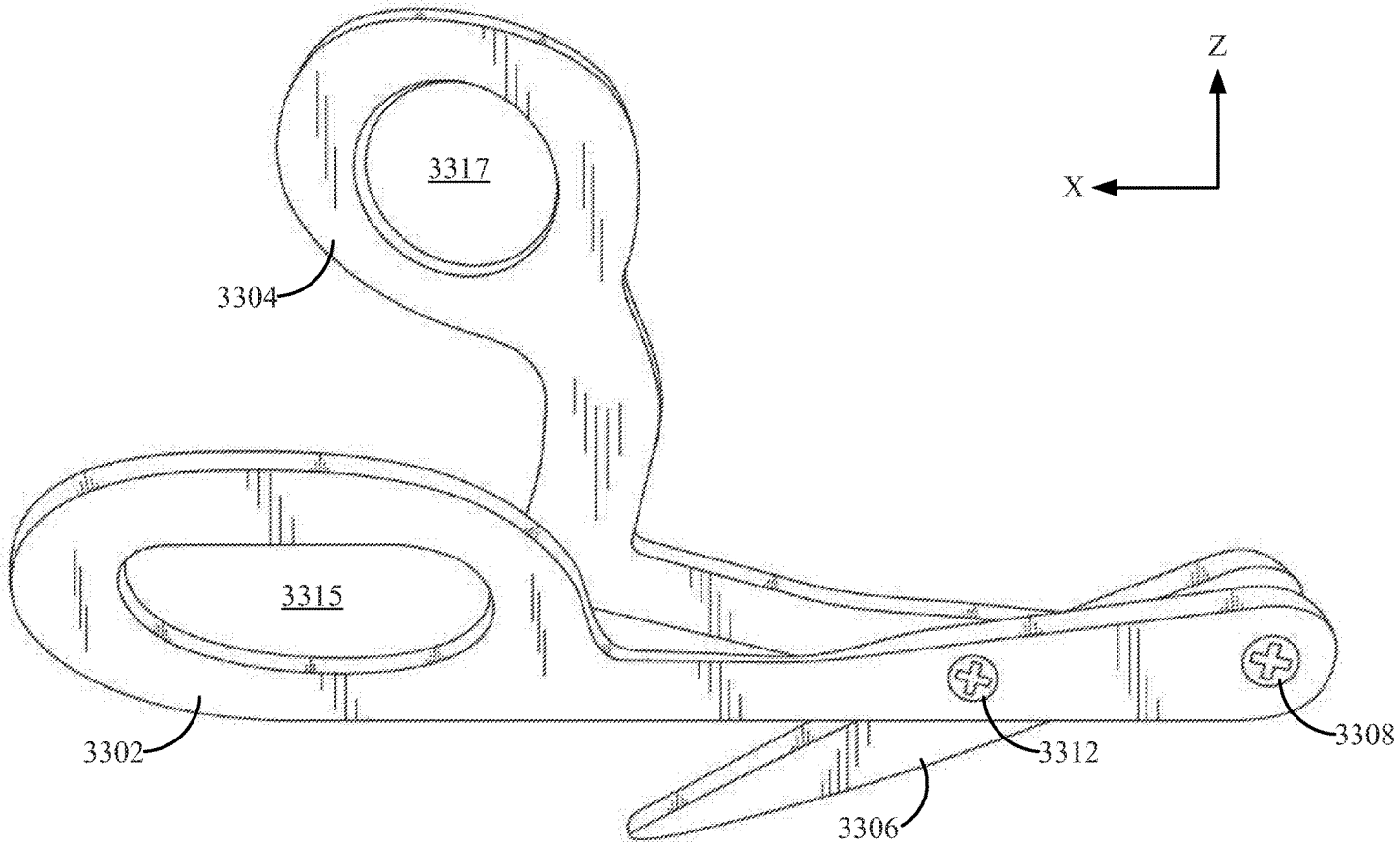
FIG. 35 illustrates a rear view of the eleventh aspect of the cutters.
Figure 36:
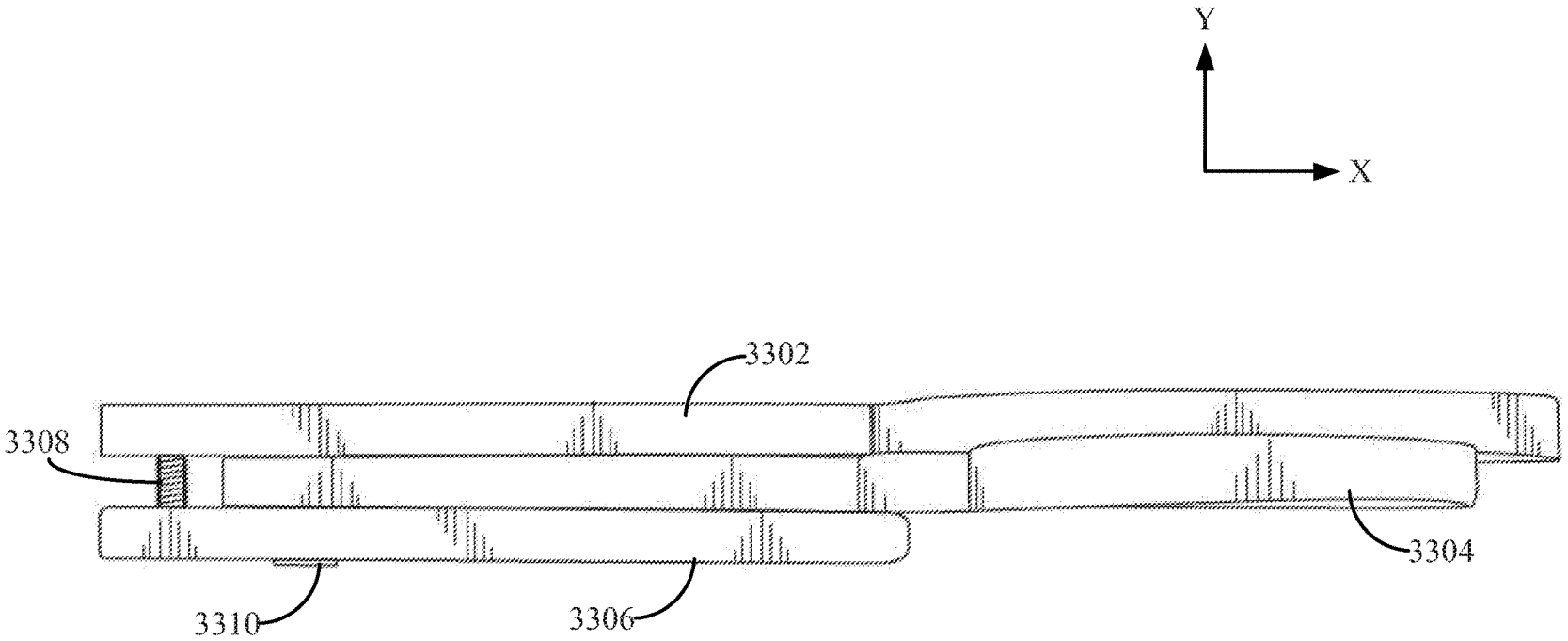
FIG. 36 illustrates a top view of the eleventh aspect of the cutters.

FIGS. 33-36 illustrate cutters 3300 according to an eleventh aspect of the disclosure. Specifically, FIG. 33 illustrates a front-perspective view of the cutters 3300 in an open position. FIG. 34 illustrates a front, exploded view of the cutters 3300. FIGS. 35 and 36 illustrate a rear view and a top view of the cutters 3300, respectively. The cutters 3300 may include a first lever 3302 (e.g., "top lever"), a second lever 3304 (e.g., "bottom lever"), a cutting lever 3306, a first member 3312 (e.g., "first pivot member" or "first pivot rod"), a second member 3308 (e.g., "second pivot member" or "second pivot rod"), and a third member 3310 (e.g., "connector").

The cutters 3300 are operated by moving the first lever 3302 and second lever 3304 toward and away from each other. A user may do that by placing one or more fingers in the finger holes 3315, 3317 of the first and second levers 3302, 3304 found near a first end 3313 of the cutters 3300 and spreading their fingers apart and back together. When the first lever 3302 and second lever 3304 are pulled apart/away from one another the cutters 3300 are in the open position. By contrast, when the first lever 3302 and second lever 3304 are moved towards each other the cutters 3300 are in the closed position. Referring to FIG. 36, the cutters 3300 may be considered "horizontally-oriented cutters" in that the first and second levers 3302, 3304 are positioned adjacent to one another in the same horizontal plane (e.g., parallel to X-Y plane).

Referring to FIGS. 33 and 34, the second member 3308, located near a second end 3314 of the cutters 3300, passes through a hole 3316 in the cutting lever 3306 and another hole 3318 in the first lever 3302 to couple the first lever 3302 and the cutting lever 3306 together. The second member 3308 bypasses (i.e., does not go through) the second lever 3304. The cutting lever 3306 may rotate with respect to the second lever 3304 and also the first lever 3302 about the second member 3308. The third member 3310 passes through a hole 3320 in the cutting lever 3306 and through another hole 3322 located in the second lever 3304. The third member 3310 couples the second lever 3304 and the cutting lever 3306 together. The first member 3312 passes through a hole 3324 in the first lever 3302 and also through a hole 3326 located in the second lever 3304. In one aspect, the third member 3310 may be one example of a means for rotating the cutting lever 3306 relative to the second lever 3304 to move the cutting lever's top edge 3332 toward or away from the second lever's bottom edge 3334 when the first lever 3302 or first handle 3315 is moved relative to the second lever 3304 or second handle 3317.

In one aspect, one or more of the members 3308, 3310, 3312 may have one or more securing ends having diameters that are larger than their cross-sectional diameter in order to secure the one or more members 3308, 3310, 3312 within the one or more levers 3302, 3304, 3306 and prevent them from falling out. According to one example, the securing ends may be fastening nuts. According to another example where the members 3308, 3310, 3312 are screws or bolts, one securing end of each member 3308, 3310, 3312 may be a screw/bolt head. According to yet another example, one or more of the members 3308, 3310, 3312 may be rivets. According to yet another example, the one or more members 3308, 3310, 3312 may not have securing ends and may simply be rods.

Opening the cutters 3300 by moving the second lever 3304 up and away from the first lever 3302 causes the second lever 3304 to rotate counterclockwise (e.g., based on cutters' 3300 orientation in FIG. 33) about the first member 3312. It also causes the third member 3310 to move down and in a counterclockwise direction relative to the first member 3312, which in turn causes the cutting lever 3306 to rotate clockwise about the second member 3308. Rotating about the second member 3308 in this fashion moves the cutting lever's top edge 3332 away from the second lever's bottom edge 3334. As described below, at least one of the cutting lever's top edge 3332 or the second lever's bottom edge 3334 may be relatively sharp in order to cut material positioned in between the cutting lever 3306 and the second lever 3304.

Closing the cutters 3300 by moving the second lever 3304 back towards the first lever 3302 causes the second lever 3304 to rotate clockwise (e.g., based on cutters' 3300 orientation in FIG. 33) about the first member 3312. It also causes the third member 3310 to move up and in a clockwise direction relative to the first member 3312, which in turn causes the cutting lever 3306 to rotate counterclockwise about the second member 3308. Rotating about the second member 3308 in this fashion moves the cutting lever's top edge 3332 toward the second lever's bottom edge 3334. As the cutters 3300 are closed, material positioned between the cutting lever 3306 and the second lever 3304 may be cut if at least one of the cutting lever's top edge 3332 or the second lever's bottom edge 3334 is sharp. The cutters 3300 may be pulled in the direction of the dashed arrow (see FIG. 33) while opening and closing the cutters 3300 as described above in order to cut additional material. The cutters 3300 may also be maneuvered in curved paths while being operated (i.e., opening and closing the cutters 3300) to cut curved shapes of material. The material cut can vary widely but may include paper, cardboard, metal, wood, plastic, rubber, etc.

Twelfth Aspect

Figure 37:
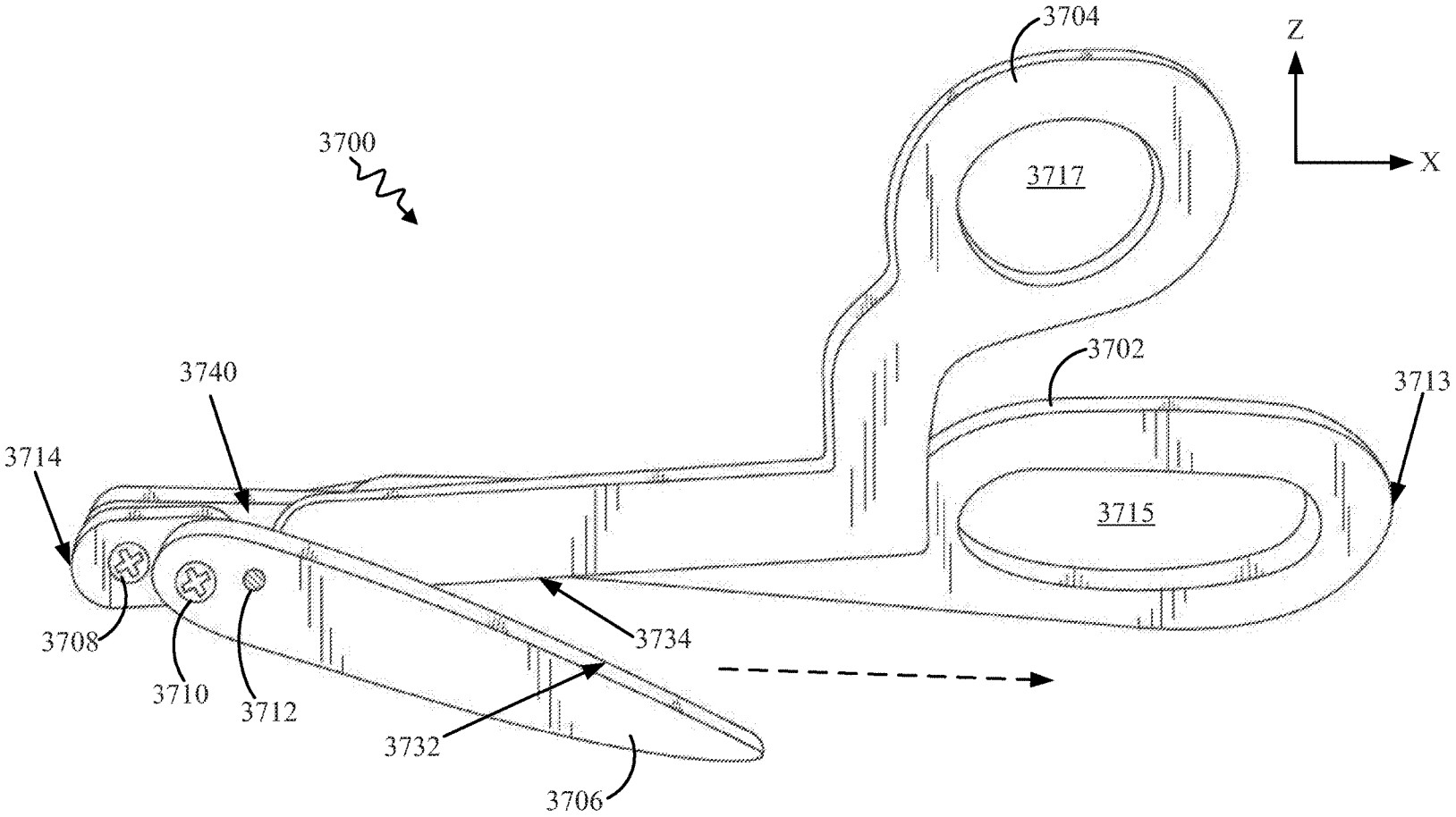
FIG. 37 illustrates a front-perspective view of a twelfth aspect of the cutters in an open position.
Figure 38:
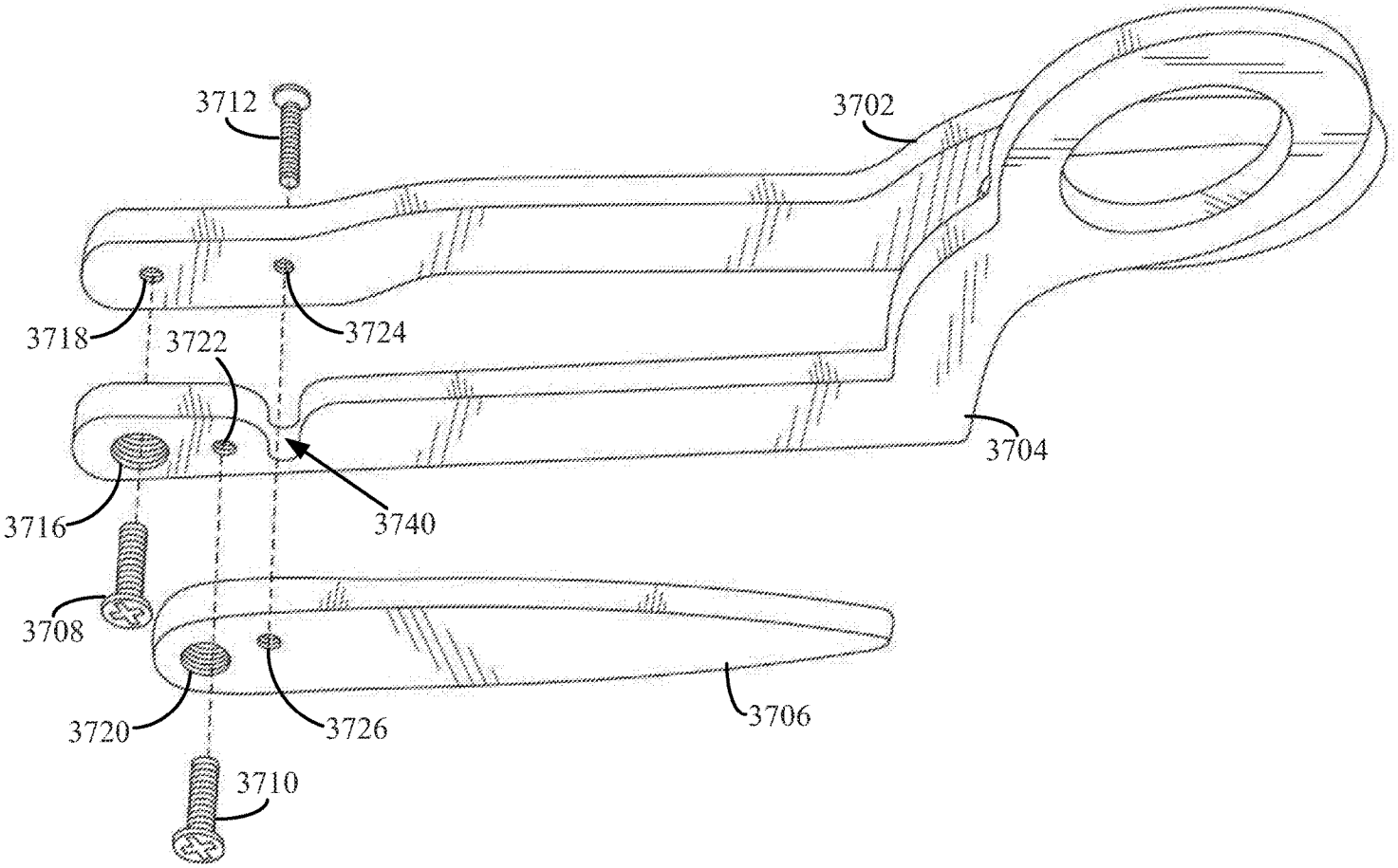
FIG. 38 illustrates a front, exploded view of the twelfth aspect of the cutters.
Figure 39:
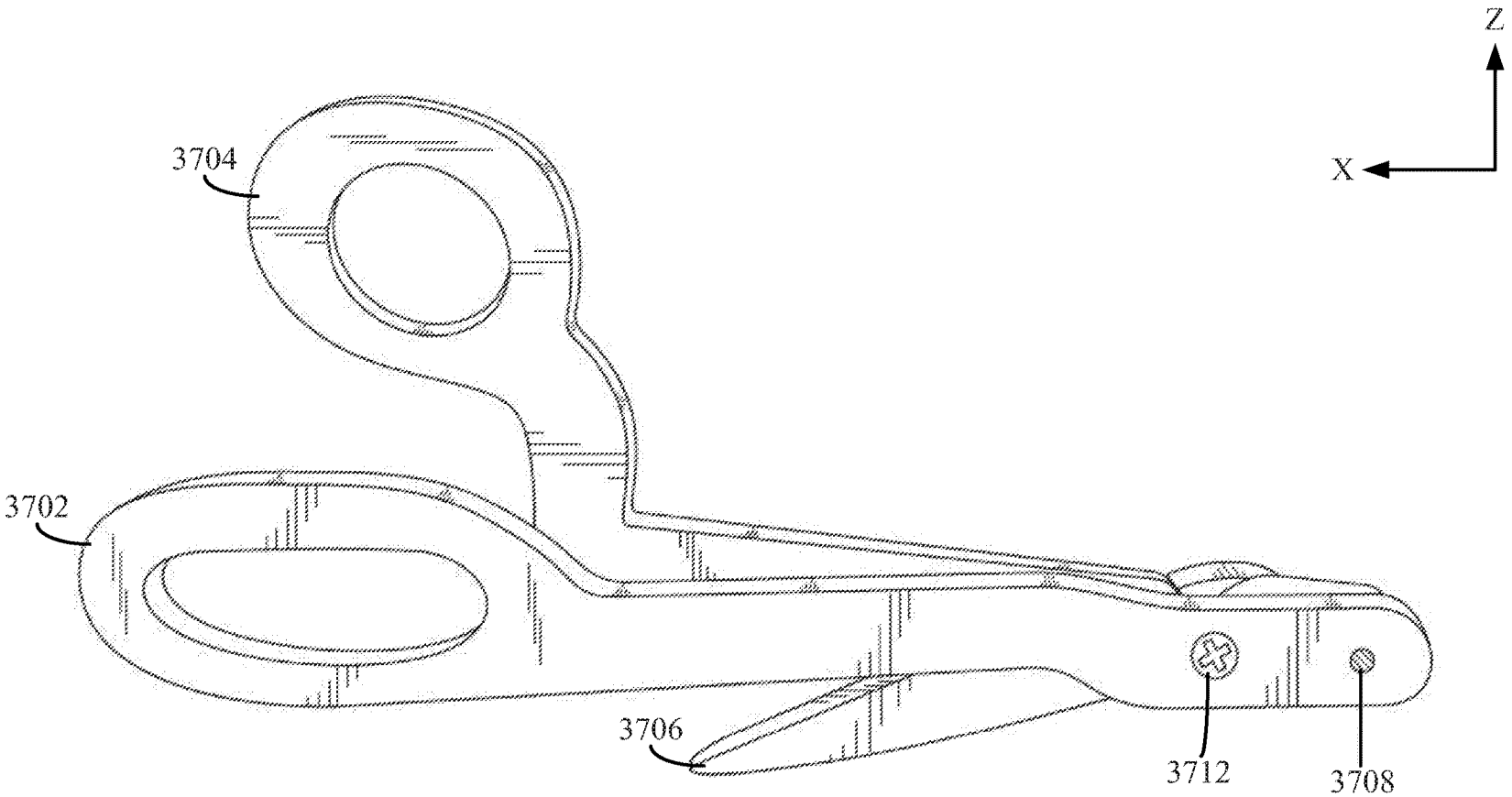
FIG. 39 illustrates a rear view of the twelfth aspect of the cutters.
Figure 40:
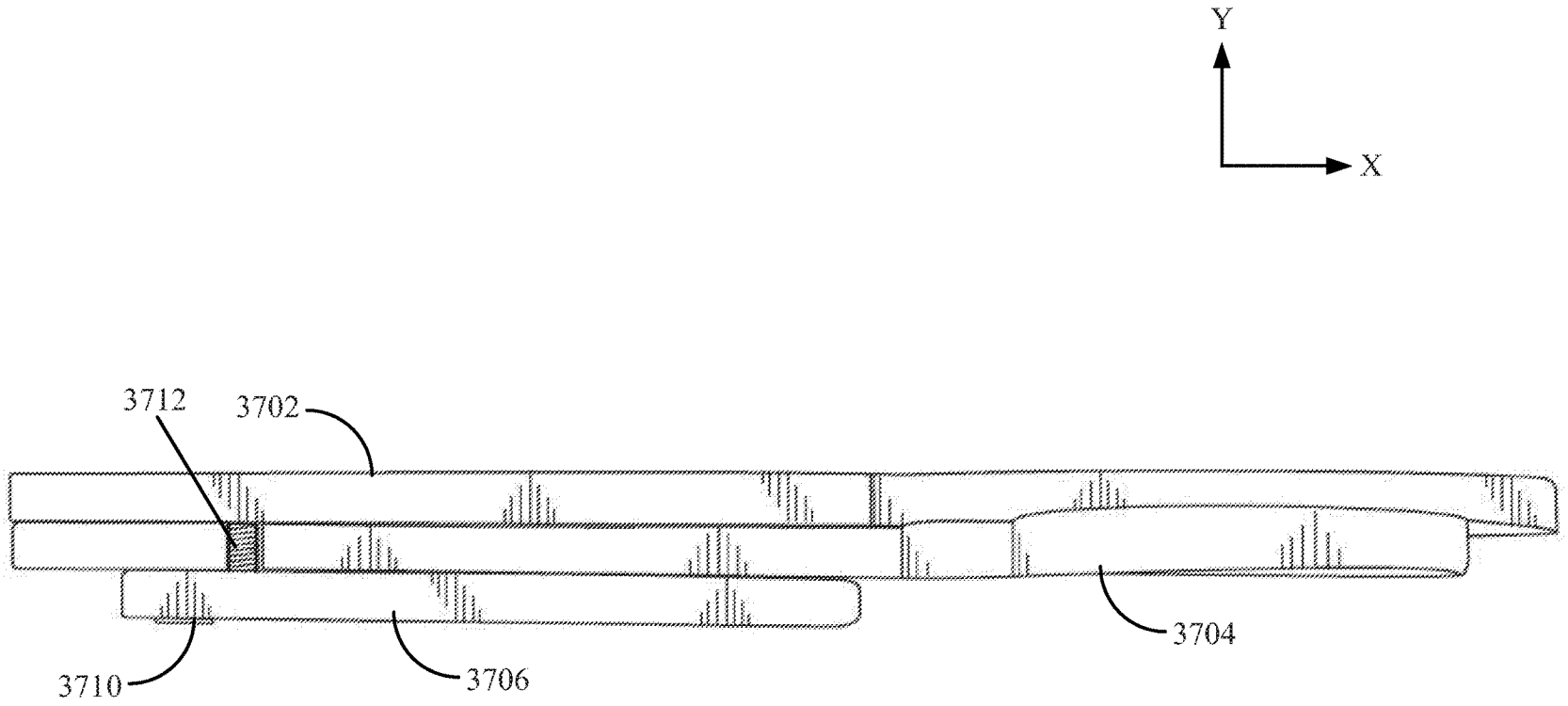
FIG. 40 illustrates a top view of the twelfth aspect of the cutters.

FIGS. 37-40 illustrate cutters 3700 according to a twelfth aspect of the disclosure. Specifically, FIG. 37 illustrates a front-perspective view of the cutters 3700 in an open position. FIG. 38 illustrates a front, exploded view of the cutters 3700. FIGS. 39 and 40 illustrate a rear view and a top view of the cutters 3700, respectively. The cutters 3700 may include a first lever 3702 (e.g., "top lever"), a second lever 3704 (e.g., "bottom lever"), a cutting lever 3706, a first member 3708 (e.g., "first pivot member" or "first pivot rod"), a second member 3712 (e.g., "second pivot member" or "second pivot rod"), and a third member 3710 (e.g., "connector").

The cutters 3700 are operated by moving the first lever 3702 and second lever 3704 toward and away from each other. A user may do that by placing one or more fingers in the finger holes 3715, 3717 (e.g., "handles") of the first and second levers 3702, 3704 found near a first end 3713 of the cutters 3700 and spreading their fingers apart and back together. When the second lever 3704 and first lever 3702 are pulled apart/away from one another the cutters 3700 are in the open position. By contrast, when the first lever 3702 and second lever 3704 are moved towards each other the cutters 3700 are in the closed position. Referring to FIG. 40, the cutters 3700 may be considered "horizontally-oriented cutters" in that the first and second levers 3702, 3704 are positioned adjacent to one another in the same horizontal plane (e.g., parallel to X-Y plane).

Referring to FIGS. 37 and 38, the first member 3708, located near a second end 3714 of the cutters 3700, passes through a hole 3716 in the second lever 3704 and another hole 3718 in the first lever 3702 to couple the first lever 3702 and the second lever 3704 together. The first lever 3702 may rotate with respect to the second lever 3704 about the first member 3708. The third member 3710 passes through a hole 3720 in the cutting lever 3706 and through another hole 3722 located in the second lever 3704. The third member 3710 couples the second lever 3704 and the cutting lever 3706 together. The second member 3712 passes through a hole 3724 in the first lever 3702 and also through a hole 3726 located in the cutting lever 3706, and consequently the cutting lever 3706 may rotate with respect to the first lever 3702 about the second member 3712. The second member 3712 bypasses (i.e., does not go through) the second lever 3704 by going through an indentation 3740 in the second lever 3704. In one aspect, the third member 3710 may be one example of a means for rotating the cutting lever 3706 relative to the second lever 3704 to move the cutting lever's top edge 3732 toward or away from the second lever's bottom edge 3734 when the first lever 3702 or first handle 3715 is moved relative to the second lever 3704 or second handle 3717.

In one aspect, one or more of the members 3708, 3710, 3712 may have securing ends having diameters that are larger than their cross-sectional diameter in order to secure the one or more members 3708, 3710, 3712 within the one or more levers 3702, 3704, 3706 and prevent them from falling out. According to one example, the securing ends may be fastening nuts. According to another example where the members 3708, 3710, 3712 are screws or bolts, one securing end of each member 3708, 3710, 3712 may be a screw/bolt head. According to yet another example, one or more of the members 3708, 3710, 3712 may be rivets. According to yet another example, the one or more members 3708, 3710, 3712 may not have securing ends and may simply be rods.

Opening the cutters 3700 by moving the second lever 3704 up and away from the first lever 3702 causes the second lever 3704 to rotate counterclockwise (e.g., based on cutters' 3700 orientation in FIG. 37) about the first member 3708. It also causes the third member 3710 to move up and in a counterclockwise direction relative to the first member 3708, which in turn causes the cutting lever 3706 to rotate clockwise about the second member 3712. Rotating about the second member 3712 in this fashion moves the cutting lever's top edge 3732 away from the second lever's bottom edge 3734. As described below, at least one of the cutting lever's top edge 3732 or the second lever's bottom edge 3734 may be relatively sharp in order to cut material positioned in between the cutting lever 3706 and the second lever 3704.

Closing the cutters 3700 by moving the second lever 3704 back towards the first lever 3702 causes the second lever 3704 to rotate clockwise (e.g., based on cutters' 3700 orientation in FIG. 37) about the first member 3708. It also causes the third member 3710 to move down and in a clockwise direction relative to the first member 3708, which in turn causes the cutting lever 3706 to rotate counterclockwise about the second member 3712. Rotating about the second member 3712 in this fashion moves the cutting lever's top edge 3732 toward the second lever's bottom edge 3734. As the cutters 3700 are closed, material positioned between the cutting lever 3706 and the second lever 3704 may be cut if at least one of the cutting lever's top edge 3732 or the second lever's bottom edge 3734 is sharp. The cutters 3700 may be pulled in the direction of the dashed arrow (see FIG. 37) while opening and closing the cutters 3700 as described above in order to cut additional material. The cutters 3700 may also be maneuvered in curved paths while being operated (i.e., opening and closing the cutters 3700) to cut curved shapes of material. The material cut can vary widely but may include paper, cardboard, metal, wood, plastic, rubber, etc.

Referring to FIGS. 5, 9, 12, 23, 26, 30, 32, 36, and 40, the first lever 102, 802, 1002, 2702, 3102, 3302, 3702, the second lever 104, 804, 1004, 2104, 2404, 2704, 3304, 3704, and the cutting lever 106, 806, 1006, 2706, 3306, 3706 are arranged in a side-by-side configuration such that each has a longitudinal axis (e.g., parallel to X-axis shown) that is substantially parallel to each other when the cutters 100, 800, 1000, 2100, 2400, 2700, 3100, 3300, 3700 are in a closed position and the first lever 102, 802, 1002, 2702, 3102, 3302, 3702 and the cutting lever 106, 806, 1006, 2706, 3306, 3706 sandwich the second lever 104, 804, 1004, 2104, 2404, 2704, 3304, 3704, and the first member 112, 810, 1012, 2712, 3312, 3708 and the second member 108, 808, 1008, 2708, 3308, 3712 have longitudinal axes (e.g., parallel to Y-axis shown) that orthogonally intersect with the longitudinal axis of at least one of the first lever, the second lever, or the cutting lever at different points along a longitudinal axis (e.g., parallel to X-axis shown) of the cutters 100, 800, 1000, 2100, 2400, 2700, 3100, 3300, 3700.

References made herein to a lever's "handle" need not be limited to a finger hole (as shown in many of the figures referenced above). Instead, a lever's "handle" may include any portion of that lever that may be grasped by a user or machine to move or manipulate the lever. As one non-limiting example, this may include an end of the lever.

One or more of the components, steps, features, or functions illustrated in FIGS. 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, combined into a single component, step, feature or function or embodied in several components, steps, or functions. Additional elements, components, steps, or functions may also be added without departing from the invention.

The various features of the invention described herein can be implemented in different systems without departing from the invention. It should be noted that the foregoing aspects of the disclosure are merely examples and are not to be construed as limiting the invention. The description of the aspects of the present disclosure is intended to be illustrative, and not to limit the scope of the claims. As such, the present teachings can be readily applied to other types of apparatuses and many alternatives, modifications.

What is claimed is:

1. Cutters comprising:

a first lever having a first end;

a second lever having a first end, a top edge, and a bottom edge;

a cutting lever having a top edge;

a first member rotatably coupling the first lever to the second lever;

a second member coupling the cutting lever to the second lever, the second member providing a pivot for the cutting lever to rotate relative to the second lever; and means for rotating the cutting lever relative to the second lever to move the cutting lever's top edge toward or away from the bottom edge when the first lever's first end is moved relative to the second lever's first end, the second lever's top edge having a shape that allows the means for rotating to bypass the second lever, wherein the first lever, the second lever, and the cutting lever are arranged in a side-by-side configuration such that the first lever and the cutting lever sandwich the second lever.

2. The cutters of claim 1, wherein the first member is positioned closer to the first lever's first end and the second lever's first end than the second member.

3. The cutters of claim 1, wherein the second member is positioned closer to the first lever's first end and the second lever's first end than the first member.

4. The cutters of claim 1, wherein the top edge of the cutting lever extends in a direction away from the second member that is substantially a same direction as the second lever's first end when the cutters are in a closed position.

5. The cutters of claim 1, wherein the means for rotating the cutting lever relative to the second lever includes an elongated shaft.

6. The cutters of claim 1, wherein the shape of the second lever's top edge includes an indentation that allows the means for rotating to couple to the first lever.

7. The cutters of claim 1, wherein at least one of the bottom edge or the cutting lever's top edge is sharp.

8. The cutters of claim 1, wherein the first lever, the second lever, and the cutting lever each have a length that is substantially parallel to each other when the cutters are in a closed position, the closed position defined by a state of the cutters where the cutting lever's top edge substantially contacts the second lever's bottom edge.

9. The cutters of claim 8, wherein the first member and the second member each have a longitudinal axis that intersects with the second lever at different points along the length of the second lever.

10. Cutters comprising:

a first lever having a first end that includes a first handle;

a second lever having a first end that includes a second handle, the second lever including a top edge and a bottom edge;

a cutting lever having a top edge;

a first member coupling the first lever to the second lever and providing a pivot for the first lever to rotate relative to the second lever;

a second member coupling the cutting lever to the second lever, the second member providing a pivot for the cutting lever to rotate relative to the second lever; and means for rotating the cutting lever relative to the second lever to move the cutting lever's top edge toward or away from the bottom edge when the first handle is moved relative to the second handle, the second lever's top edge having an indentation that allows the means for rotating to couple to the first lever, wherein the first lever, the second lever, and the cutting lever are arranged in a side-by-side configuration such that the second lever is positioned between the first lever and the cutting lever.

11. The cutters of claim 10, wherein the first member is positioned closer to the first and second handles than the second member.

12. The cutters of claim 10, wherein the second member is positioned closer to the first and second handles than the first member.

13. The cutters of claim 10, wherein the top edge of the cutting lever extends in a direction away from the second member that is substantially a same direction as the second handle when the cutters are in a closed position, the closed position defined by a state of the cutters where the cutting lever's top edge substantially meets the second lever's bottom edge.

14. The cutters of claim 10, wherein the means for rotating the cutting lever relative to the second lever includes an elongated shaft.

15. The cutters of claim 10, wherein at least one of the bottom edge or the cutting lever's top edge is sharp.

16. The cutters of claim 10, wherein the first lever, the second lever, and the cutting lever each have a longitudinal axis that is substantially parallel to each other when the cutters are in a closed position, the closed position defined by a state of the cutters where the cutting lever's top edge substantially contacts the second lever's bottom edge.

17. The cutters of claim 16, wherein the first member and the second member each have a longitudinal axis that intersects with the second lever at different points along the longitudinal axis of the second lever.

18. Cutters comprising:

a first lever having a first end that includes a first handle;

a second lever having a first end that includes a second handle, the second lever including a top edge and a bottom edge;

a cutting lever having a top edge;

a first member rotatably coupling the first lever to the second lever;

a second member coupling the cutting lever to the first lever, the second member providing a pivot for the cutting lever to rotate relative to the second lever; and a third member coupling the cutting lever to the second lever, the third member adapted to rotate the cutting lever about the second member to move the cutting lever's top edge toward or away from the bottom edge when the first handle is moved relative to the second handle, the second lever having an upper edge shape that allows the second member to bypass the second lever, wherein the first lever, the second lever, and the cutting lever are arranged in a side-by-side configuration such that the first lever and the cutting lever sandwich the second lever.

* * * * *